US007339562B2

(12) United States Patent
Ikeda

(10) Patent No.: US 7,339,562 B2
(45) Date of Patent: Mar. 4, 2008

(54) ORGANIC ELECTROLUMINESCENCE PIXEL CIRCUIT

(75) Inventor: Kyoji Ikeda, Gifu (JP)

(73) Assignee: Sanyo Electric Co., Ltd. (JP)

( * ) Notice: Subject to any disclaimer, the term of this patent is extended or adjusted under 35 U.S.C. 154(b) by 479 days.

(21) Appl. No.: 11/103,742

(22) Filed: Apr. 12, 2005

(65) Prior Publication Data

US 2005/0243036 A1 Nov. 3, 2005

(30) Foreign Application Priority Data

| | | |
|---|---|---|
| Apr. 12, 2004 | (JP) | 2004-117332 |
| Mar. 28, 2005 | (JP) | 2005-092566 |
| Mar. 28, 2005 | (JP) | 2005-092588 |
| Mar. 30, 2005 | (JP) | 2005-096835 |

(51) Int. Cl.
*G09G 3/32* (2006.01)

(52) U.S. Cl. ..... 345/82

(58) Field of Classification Search ..... 345/82
See application file for complete search history.

(56) References Cited

U.S. PATENT DOCUMENTS 6,229,506 B1 5/2001 Dawson et al.

7,145,455 B2 * 12/2006 Eskildsen et al. ..... 340/541

FOREIGN PATENT DOCUMENTS

JP 2002-514320 5/2002

* cited by examiner

*Primary Examiner*—Richard Hjerpe
*Assistant Examiner*—My-Chau T Tran
(74) *Attorney, Agent, or Firm*—Cantor Colburn LLP

(57) ABSTRACT

A potential on a control terminal of a driver transistor is controlled and a drive current corresponding to the potential is supplied to an organic electroluminescence element. A drive controlling transistor is inserted between the driver transistor and the organic electroluminescence element and the drive current is switched on and off by the drive controlling transistor. A short-circuiting transistor is provided which controls whether or not the driver transistor is to be diode-connected. A selection transistor controls whether or not a data signal from a data line is to be supplied to the control terminal of the driver transistor. A capacitor is placed between the selection transistor and the control terminal of the driver transistor and a connection between a terminal of the capacitor on the side of the selection transistor and a predetermined power supply is switched on and off by a potential controlling transistor.

16 Claims, 31 Drawing Sheets

| | | | |
|---|---|---|---|
| GL(T1) | OFF | ON | OFF |
| ES(T5) | ON | OFF | ON |

| | | | |
|---|---|---|---|
| GL(T1) | OFF | ON | OFF |
| CS(T2) | ON | OFF | ON |
| ES(T5) | ON | OFF | ON |

| | | | |
|---|---|---|---|
| GL(T1) | OFF | ON | OFF |
| RST(T3) | OFF | ON | OFF |
| ES(T5) | ON | OFF | ON |

| | | | |
|---|---|---|---|
| GL(T1) | OFF | ON | OFF |
| ES(T5) | ON | OFF | ON |

ORGANIC ELECTROLUMINESCENCE PIXEL CIRCUIT

CROSS-REFERENCE TO RELATED APPLICATIONS

The entire disclosure of Japanese Patent Application Nos. 2004-117332, 2005-92566, 2005-92588, and 2005-96835 including specification, claims, drawings and abstract is incorporated herein by reference.

BACKGROUND OF THE INVENTION

1. Field of the Invention

The present invention relates to an organic electroluminescence (hereinafter simply referred to as "EL") pixel circuit, which controls a drive current to be supplied to an organic EL element based on a data signal.

2. Description of the Related Art

Because electroluminescence display devices wherein an EL element which is a self-emitting element is used as an emissive element in each pixel have advantages such as the fact that the device is self-emitting, that the thickness can be reduced, and that the power consumption is small, they have attracted much attention as display devices offering alternatives to display devices such as liquid crystal display (LCD) devices and CRT (cathode ray tube) display devices.

In particular, an active matrix EL display device in which a switching element such as a thin film transistor (hereinafter simply referred to as "TFT") for individually controlling an EL element is provided in each pixel and the EL element is controlled for each pixel can achieve a high resolution display.

In an active matrix EL display device, a plurality of gate lines extend along a row (horizontal) direction on a substrate, a plurality of data lines and power supply lines extend along a column (vertical) direction, and each pixel comprises an organic EL element, a selection TFT, a driver TFT, and a storage capacitor. When a gate line is selected, the selection TFT is switched on and a data voltage on the data line (voltage video signal) is charged into the storage capacitor. The driver TFT is switched on by the charged voltage and power is supplied from the power supply line to the organic EL element.

In this pixel circuit, when the threshold voltages of the driver TFTs in the pixel circuits arranged in a matrix form vary, the brightness varies, and as a result, there is a problem that the display quality is degraded. However, the characteristics of the TFTs in the pixel circuits over the entire display panel cannot be made identical to each other, and it is therefore difficult to prevent variation in the threshold values for switching the TFTs on and off.

It is therefore desirable to prevent the effects of variation in the threshold values among the driver TFTs on the display.

Various structures have been proposed as a circuit for preventing the effects of variation in the threshold values among the TFTs (for example, Japanese Publication of Unexamined PCT Patent Application No. 2002-514320).

These configurations, however, require a circuit for compensating for the variation in threshold value. Therefore, when these circuits are used, the number of elements in the pixel circuit is increased, resulting in a problem that the aperture ratio is reduced. In addition, when a circuit for compensation is added, there is a problem that the peripheral circuit for driving the pixel circuit must also be changed.

SUMMARY OF THE INVENTION

The present invention advantageously provides a pixel circuit which can effectively compensate for a variation in threshold voltages among driver transistors.

According to one aspect of the present invention, a voltage on a control terminal of the driver transistor can be set corresponding to a data voltage and a threshold voltage of the driver transistor by switching a short-circuiting transistor on while the selection transistor is switched on. Therefore, it is possible to supply a drive current corresponding to the data voltage to the organic EL element regardless of the variation in the threshold voltages among the driver transistors.

In addition, one terminal of a potential controlling transistor is connected to an emission set line. Because a voltage from a predetermined power supply is set on the emission set line, the voltage on the emission set line is stable, basically without being affected by factors such as the current flowing through the organic EL element. It is therefore possible to accurately set the voltage on the control terminal of the driver transistor.

Moreover, because an n-channel transistor is employed as the driver transistor, the characteristics of the transistor are superior and the active layer of the transistor can be formed using amorphous silicon. Furthermore, even when a capacitor is inserted between the selection transistor and the control end of the driver transistor, it is possible to use a data signal having a polarity identical to the data signal in a structure of the related art in which the selection transistor is directly connected to the control terminal of a p-channel driver transistor.

BRIEF DESCRIPTION OF THE DRAWINGS

Preferred embodiments of the present invention will be described in detail based on the following drawings, wherein.

DESCRIPTION OF PREFERRED EMBODIMENTS

Figure 1:
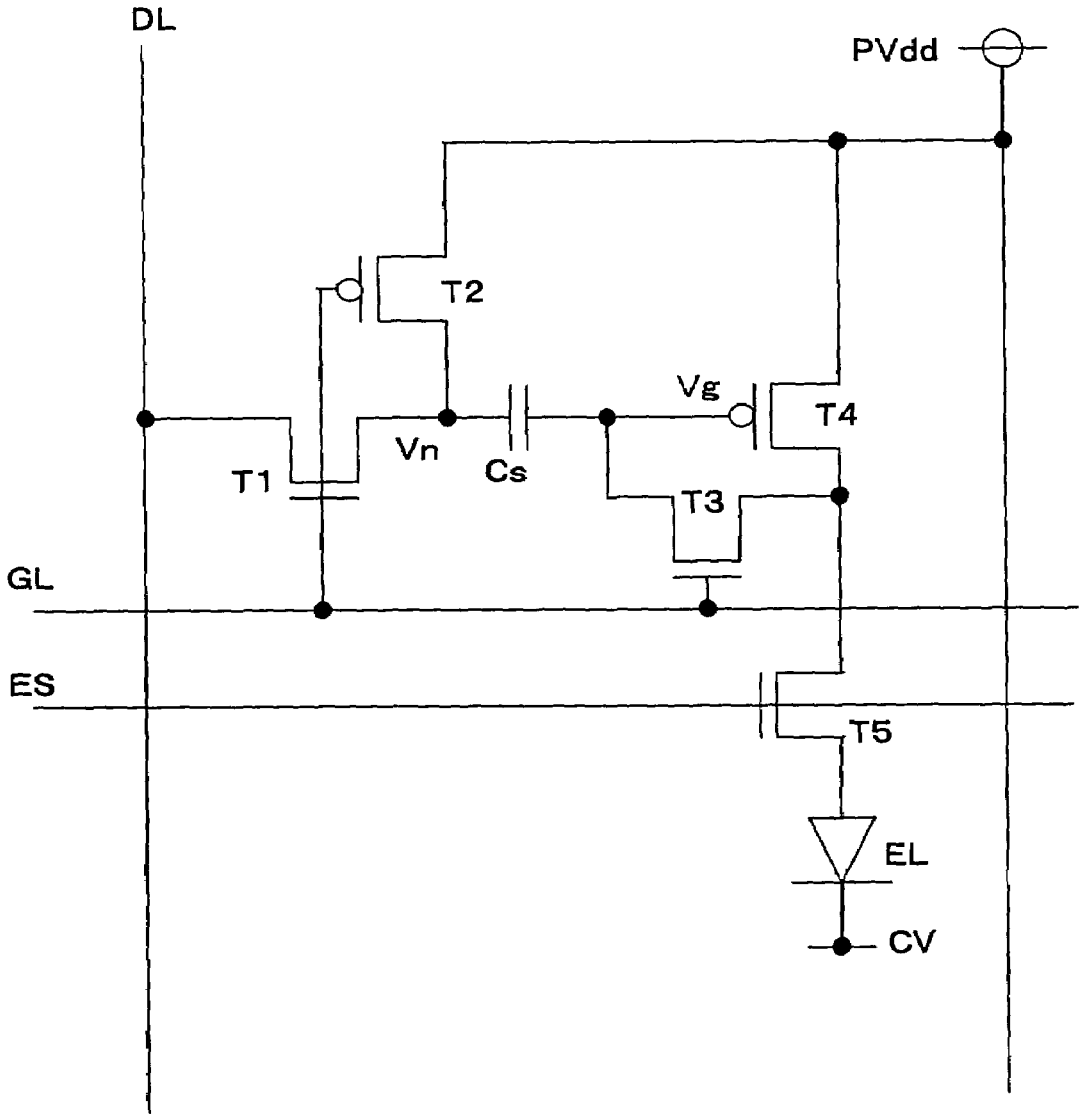
FIG. 1 is a diagram showing a structure of a pixel circuit according to a preferred embodiment of the present invention.

Preferred embodiments (hereinafter simply referred to as "embodiments") of the present invention will now be described referring to the drawings.

FIG. 1 is a diagram showing a structure of a pixel circuit according to a preferred embodiment of the present invention. A data line DL extends along a vertical direction and supplies a data signal (data voltage Vsig) regarding a display brightness of a pixel to a pixel circuit. One data line DL is provided corresponding to one column of pixels and sequentially supplies a corresponding data voltage Vsig to the pixels along the vertical direction.

A drain of an n-channel selection transistor T1 is connected to the data line DL and a source of the selection transistor T1 is connected to one terminal of a capacitor Cs. A gate of the selection transistor T1 is connected to a gate line GL extending along the horizontal direction. Gates of the selection transistors T1 of pixel circuits along the horizontal direction are connected to the gate line GL.

A gate of a p-channel potential controlling transistor T2 is connected to the gate line GL. Therefore, when the selection transistor T1 is switched on, the potential controlling transistor T2 is switched off and when the selection transistor T1 is switched off, the potential controlling transistor T2 is switched on. A source of the potential controlling transistor T2 is connected to a power supply line (positive power supply) PVdd and a drain of the potential controlling transistor T2 is connected to the capacitor Cs and to the source of the selection transistor T1. The power supply line PVdd also extends along the vertical direction and supplies the power supply voltage PVdd to each pixel along the vertical direction.

Another terminal of the capacitor Cs is connected to a gate of a p-channel driver transistor T4. A source of the driver transistor T4 is connected to the power supply line PVdd and a drain of the driver transistor T4 is connected to a drain of an n-channel drive controlling transistor T5. A source of the drive controlling transistor T5 is connected to an anode of an organic EL element EL and a gate of the drive controlling transistor T5 is connected to an emission set line ES extending along the horizontal direction. A cathode of the organic EL element EL is connected to a cathode power supply (negative power supply) CV having a low voltage.

A drain of an n-channel short-circuiting transistor T3 is connected to the gate of the driver transistor T4. A source of the short-circuiting transistor T3 is connected to the drain of the driver transistor T4 and a gate of the short-circuiting transistor T3 is connected to the gate line GL.

As described, in the present embodiment, the data line DL and the power supply line PVdd are provided along the vertical direction and the gate line GL and the emission set line ES are provided along the horizontal direction.

Operation of the pixel circuit will now be described.

Figure 2:
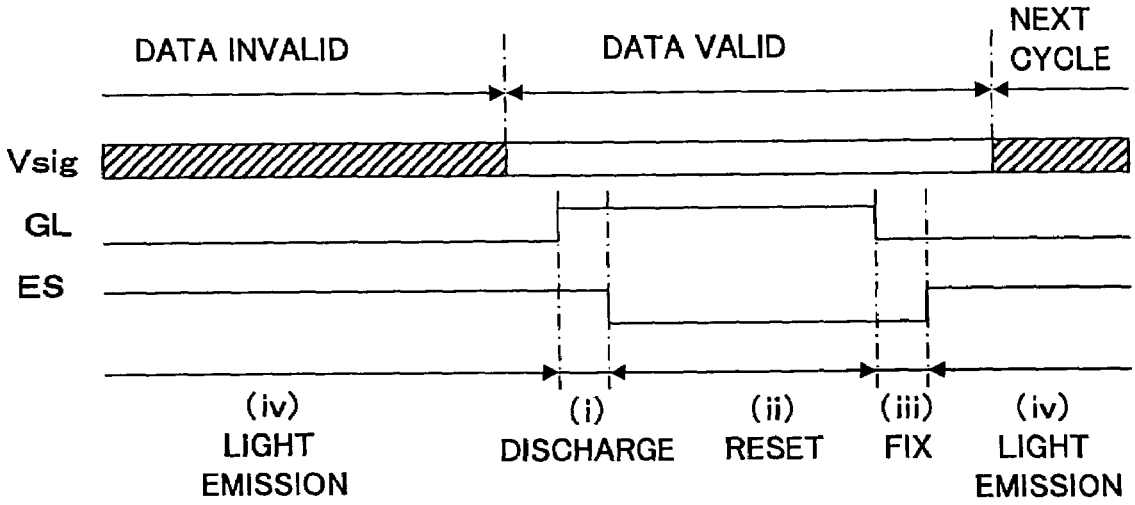
FIG. 2 is a chart for explaining an operation.

As shown in FIG. 2, the pixel circuit has 4 states depending on the states (H level and L level) of the gate line GL and the emission set line ES. That is, the pixel circuit has (i) a discharge state in which GL is at the H level and ES is at H the level; (ii) a reset state in which GL is at the H level and ES is at the L level; (iii) a potential fixing state in which GL is at the L level and ES is at the L level; and (iv) a light emission state in which GL is at the L level and ES is at the H level, and these states are repeated. In other words, while data on the data line DL is activated, (i) discharge process is performed, (ii) reset process is then performed to determine the charged voltage of the capacitor Cs, the gate potential Vg is fixed in (iii) a potential fixing process, and light is emitted from the organic EL element EL due to a drive current corresponding to the fixed gate voltage.

As shown in FIG. 2, the data on the data line DL is activated before the (i) discharge step and is inactivated after the (iii) fixing step. Therefore, effective data is set on the data line from the (i) discharge step to the (iii) fixing step.

Each of these states will now be described. In FIGS. 3-6, transistors which are switched off are shown with a broken line.

(i) Discharge (GL=H and ES=H)

Figure 3:
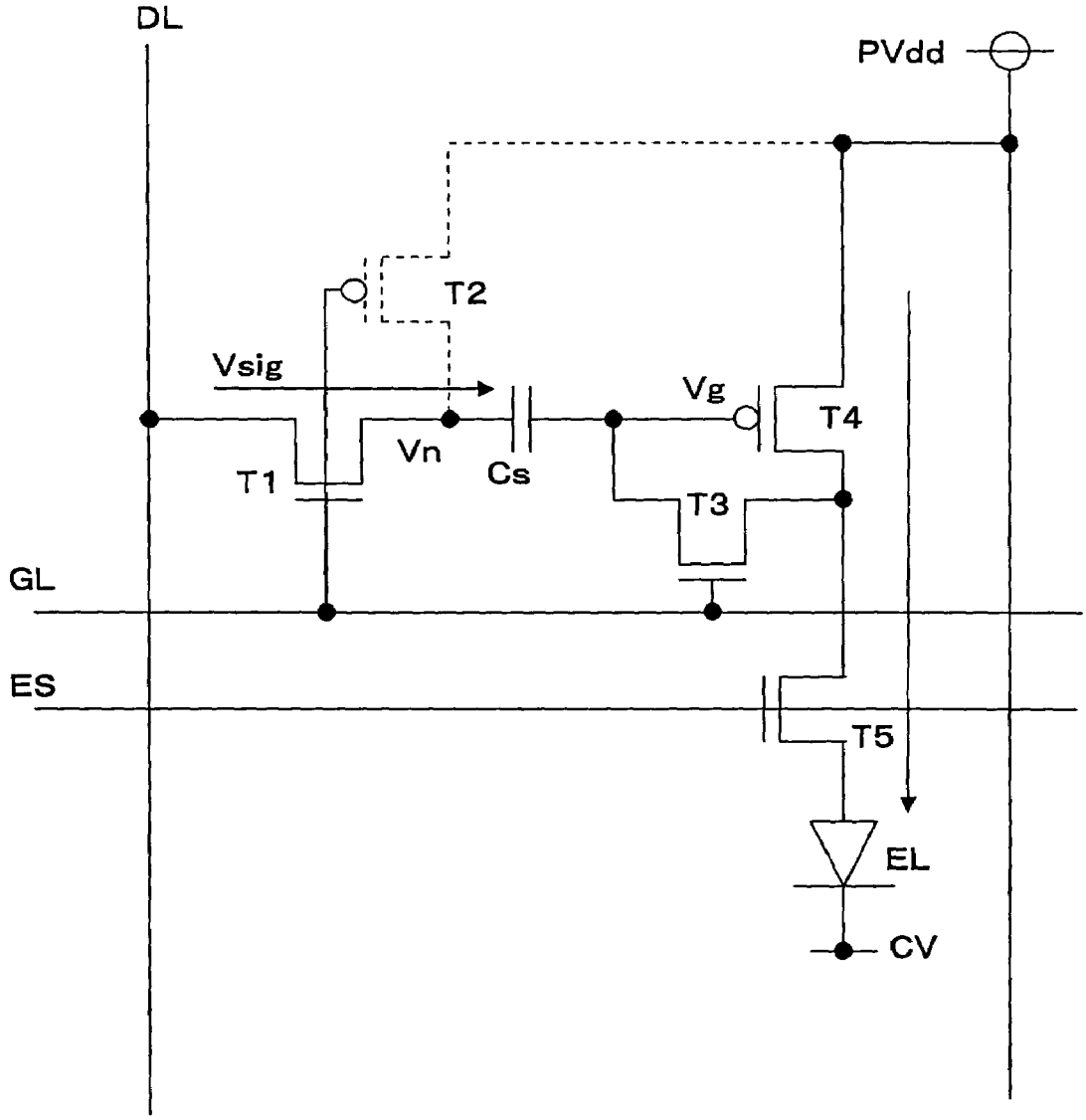
FIG. 3 is a diagram for explaining a discharge step.

While the data voltage Vsig is supplied on the data line DL, the gate line GL and the emission set line ES are both set to H level (high level). With this operation, the selection transistor T1, the drive controlling transistor T5, and the short-circuiting transistor T3 are switched on and the potential controlling transistor T2 is switched off. Therefore, as shown in FIG. 3, a current is supplied from the power supply line PVdd through the driver transistor T4, the drive controlling transistor T5, and the organic EL element EL to the cathode power supply CV while the voltage Vn on a terminal of the capacitor Cs on the side of the selection transistor T1 is set at Vsig. With this process, the charges stored on the gate of the driver transistor T4 are withdrawn and the gate voltage Vg of the driver transistor T4 is set to a predetermined low voltage.

(ii) Reset (GL=H and ES=L)

Figure 4:
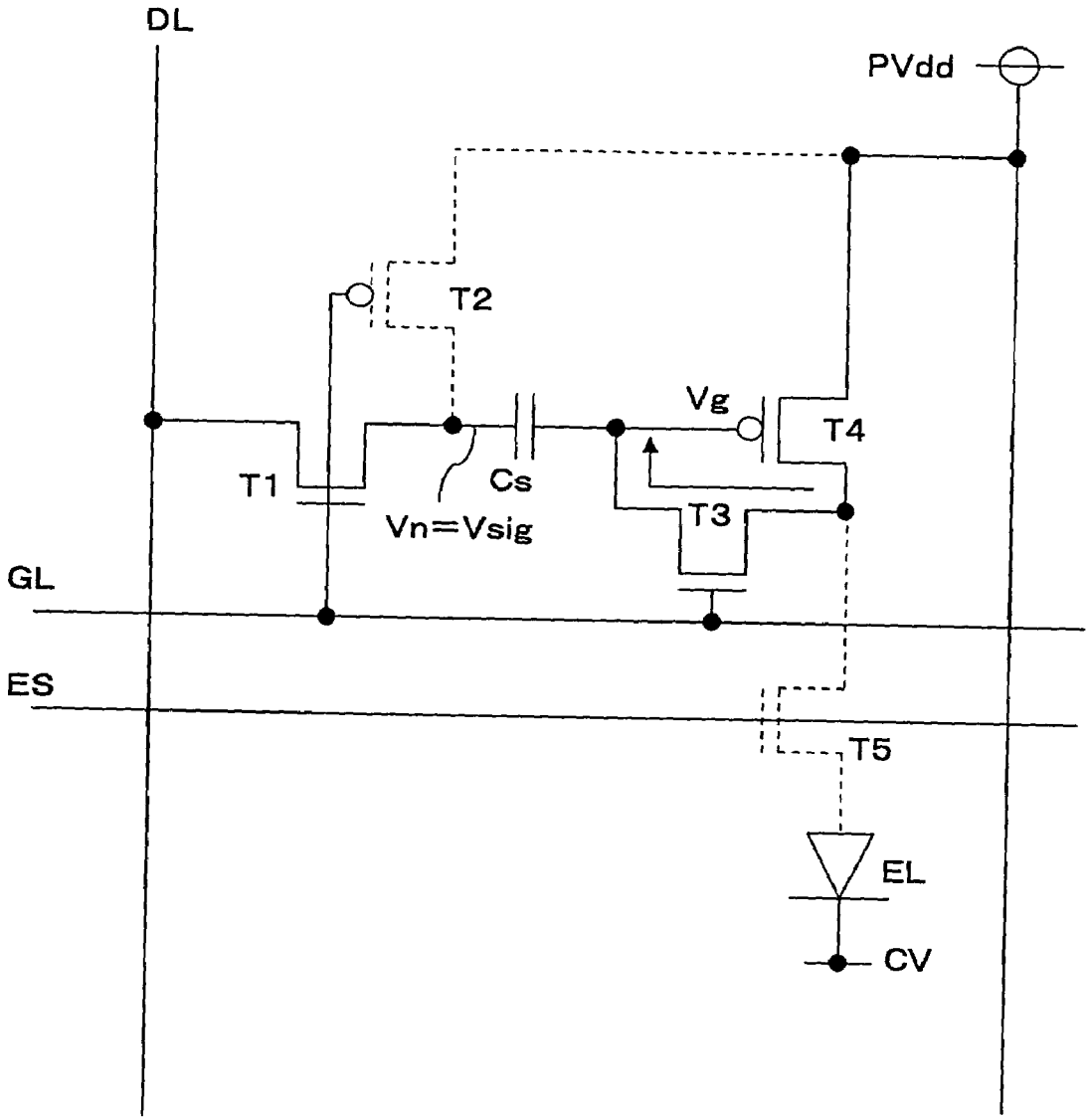
FIG. 4 is a diagram for explaining a reset step.

From the above-described discharge state, the emission set line ES is changed to L level (low level). With this process, the drive controlling transistor T5 is switched off as shown in FIG. 4 and the gate voltage Vg of the driver transistor T4 is reset to Vg0=PVdd−|Vtp|. The voltage Vtp is the threshold voltage of the driver transistor T4. In other words, because the gate and the drain of the driver transistor T4 are connected (short-circuited) by the short-circuiting transistor T3 while the source of the driver transistor T4 is connected to the power supply PVdd, the gate voltage of the driver transistor T4 is set to a voltage which is lower than the power supply PVdd by the threshold voltage |Vtp| of the driver transistor T4 and the driver transistor T4 is switched off. In this process, the potential Vn of the capacitor Cs on the terminal on the side of the selection transistor T1 is Vsig and a voltage of |Vsig−(PVdd−|Vtp|)| is charged to the capacitor Cs.

(iii) Potential Fixing (GL=L and ES=L)

Figure 5:
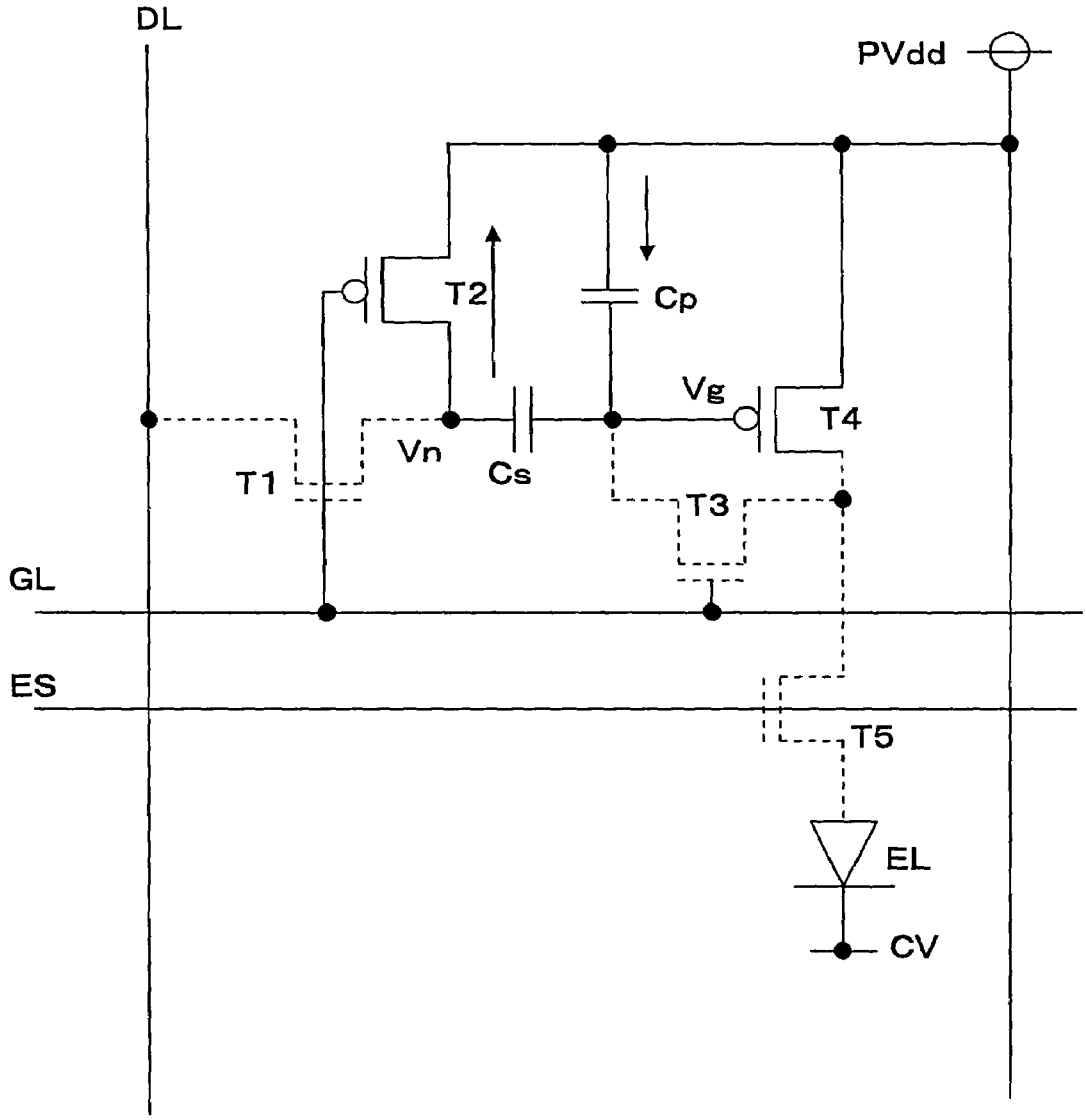
FIG. 5 is a diagram for explaining a potential fixing step.

Next, the gate line GL is set at L level so that the selection transistor T1 and the short-circuiting transistor T3 are switched off and the potential controlling transistor T2 is switched on. With this process, the gate of the driver transistor T4 is disconnected from the drain as shown in FIG. 5. With the potential controlling transistor T2 being switched on, the voltage Vn is set at PVdd. Therefore, the gate potential Vg of the driver transistor T4 is shifted according to the change of Vn. Because a parasitic capacitance Cp is present between the gate and the source of the driver transistor T4, the gate potential Vg is affected by the parasitic capacitance Cp.

(iv) Light Emission (GL=L and ES=H)

Figure 6:
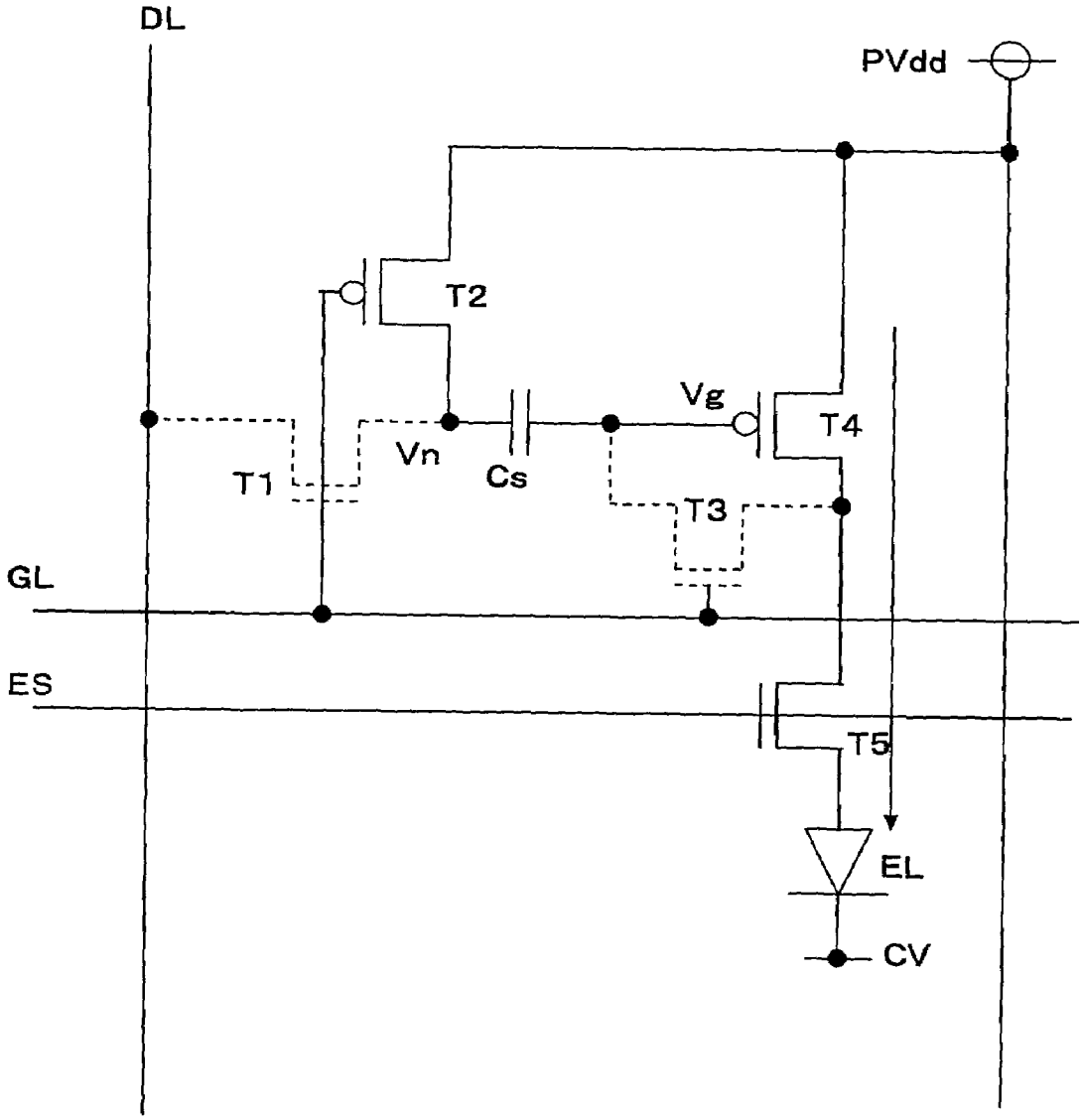
FIG. 6 is a diagram for explaining a light emission step.

Next, the emission set line ES is set at H level so that the drive controlling transistor T5 is switched on as shown in FIG. 6 and a drive current from the driver transistor T4 flows to the organic EL element EL. The drive current in this process is a drain current of the driver transistor T4 determined by the gate voltage of the driver transistor T4 and the drain current is independent from the threshold voltage Vtp of the driver transistor T4. Therefore, it is possible to inhibit a variation in the amount of light emission due to a variation in the threshold voltage.

These processes will now be described in more detail referring to FIG. 7.

Figure 7:
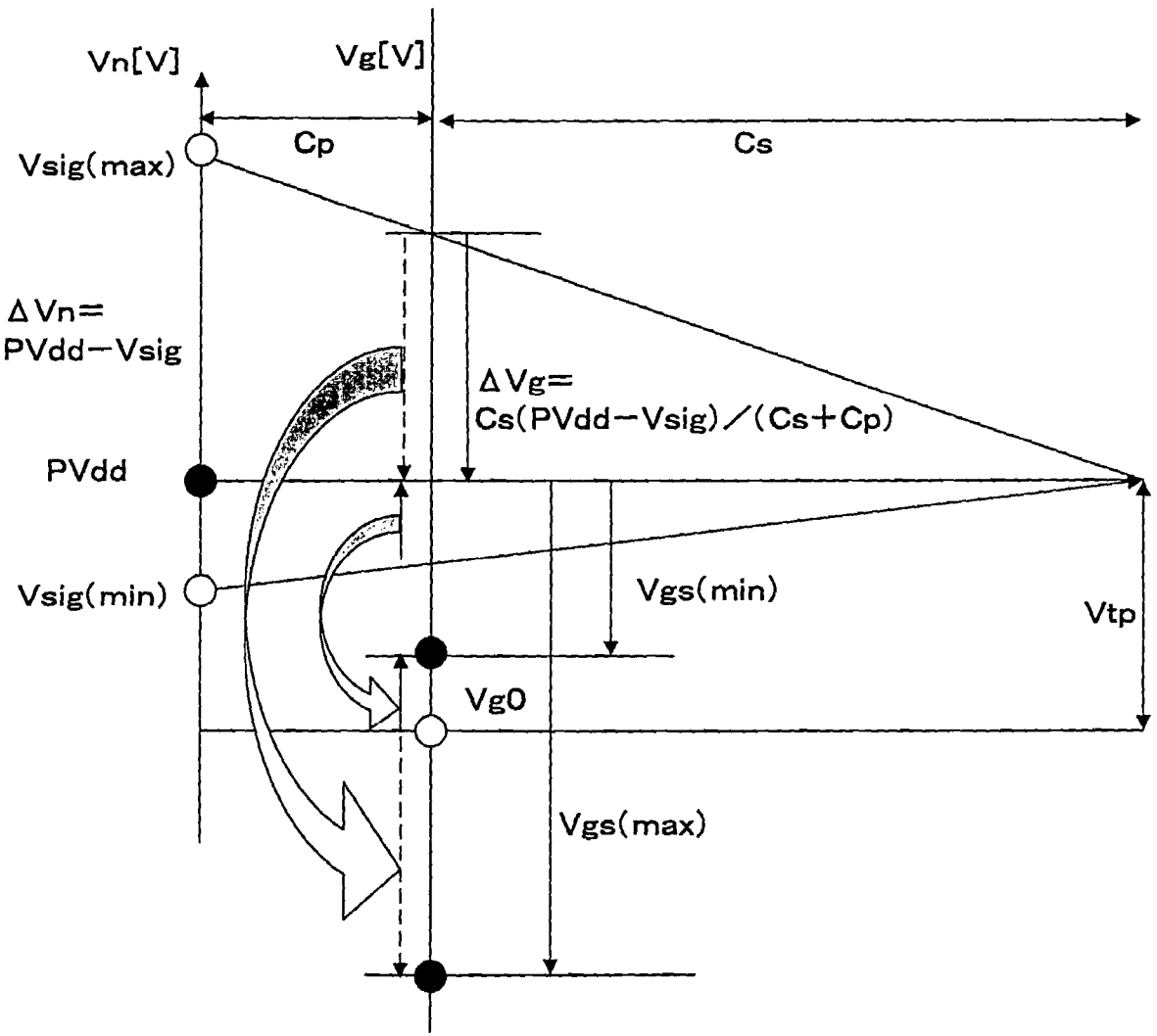
FIG. 7 is a diagram for explaining a state of potential change from the reset step to the potential fixing step.

As described, as shown by white circles in FIG. 7, after the (ii) reset step, Vn (=Vsig) has a value between Vsig (max) and Vsig(min), Vg is at the voltage Vg0 which is lower than PVdd by the threshold voltage Vtp of the driver transistor T4. That is, Vg=Vg0=PVdd+Vtp (Vtp<0) and Vn=Vsig.

In the (iii) potential fixing step, Vn changes from Vsig to PVdd. Taking into consideration the capacitances of Cs and Cp, the amount of change ΔVg can be represented by ΔVg=Cs (PVdd−Vsig)/(Cs+Cp).

Therefore, as shown by black circles in FIG. 7, Vn and Vg have the values of Vn=PVdd and Vg=PVdd+Vtp+ΔVg=PVdd+Vtp+Cs(PVdd−Vsig)/(Cs+Cp).

Because Vgs=Vg−PVdd, Vgs=Vtp+Cs(PVdd−Vsig)/(Cs+Cp).

A drain current I can be represented as $I=(1/2)\beta(Vgs-Vtp)^2$. When the above-described equations are substituted into this equation, the drain current I can be represented as:

$$I = (1/2)\beta\{Vtp + Cs(PVdd - Vsig)/(Cs + Cp) - Vtp\}^2$$

$$= (1/2)\beta\{Cs(PVdd - Vsig)/(Cs + Cp)\}^2$$

$$= (1/2)\beta\alpha(Vsig - PVdd)^2$$

wherein $\alpha=\{Cs/(Cs+Cp)\}^2$, β is amplification of the driver transistor T4, and $\beta=\mu\epsilon$ Gw/Gl, where μ represents mobility of the carrier, ϵ represents a dielectric constant, Gw represents a gate width, and Gl represents a gate length.

As described above, the equation for the drain current I does not contain Vtp and the drain current I is proportional to the square of (Vsig−PVdd). Therefore, it is possible to remove the influences of variation in the threshold voltages among driver transistors T4 and light emission corresponding to the data voltage Vsig can be achieved.

Figure 8:
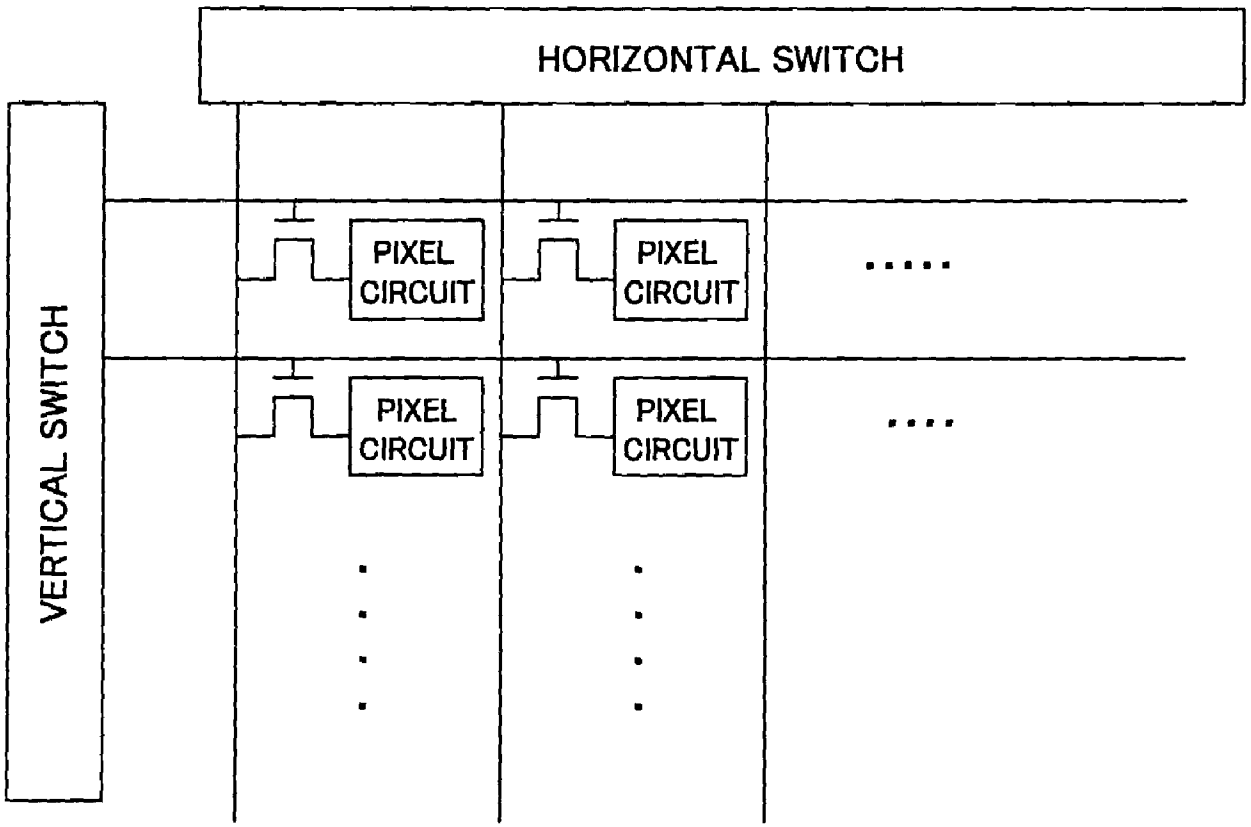
FIG. 8 is a diagram showing an overall structure of a panel.

In the above description, operation for one pixel has been described. In practice, a display panel comprises a plurality of pixels arranged in a matrix form, and a data voltage Vsig corresponding to a brightness signal corresponding to each pixel is supplied so that light is emitted from each organic EL element. Specifically, as shown in FIG. 8, a horizontal switch circuit HSR and a vertical switch circuit VSR are provided on a display panel and the states of the data line DL, the gate line GL, and other lines such as the emission set line ES are controlled based on the outputs from the horizontal switch circuit HSR and the vertical switch circuit VSR. In particular, one gate line GL is provided corresponding to pixels along the horizontal direction and each gate line GL is activated by the vertical switch VSR one at a time. Then, during one horizontal period in which one gate line GL is activated, a data voltage is supplied in a point (pixel) sequential manner to all data lines DL by the horizontal switch HSR so that data is written to the pixel circuits corresponding to one horizontal line. Then, light emission is achieved in each pixel circuit according to the written data voltage until one vertical period elapses.

Figure 9:
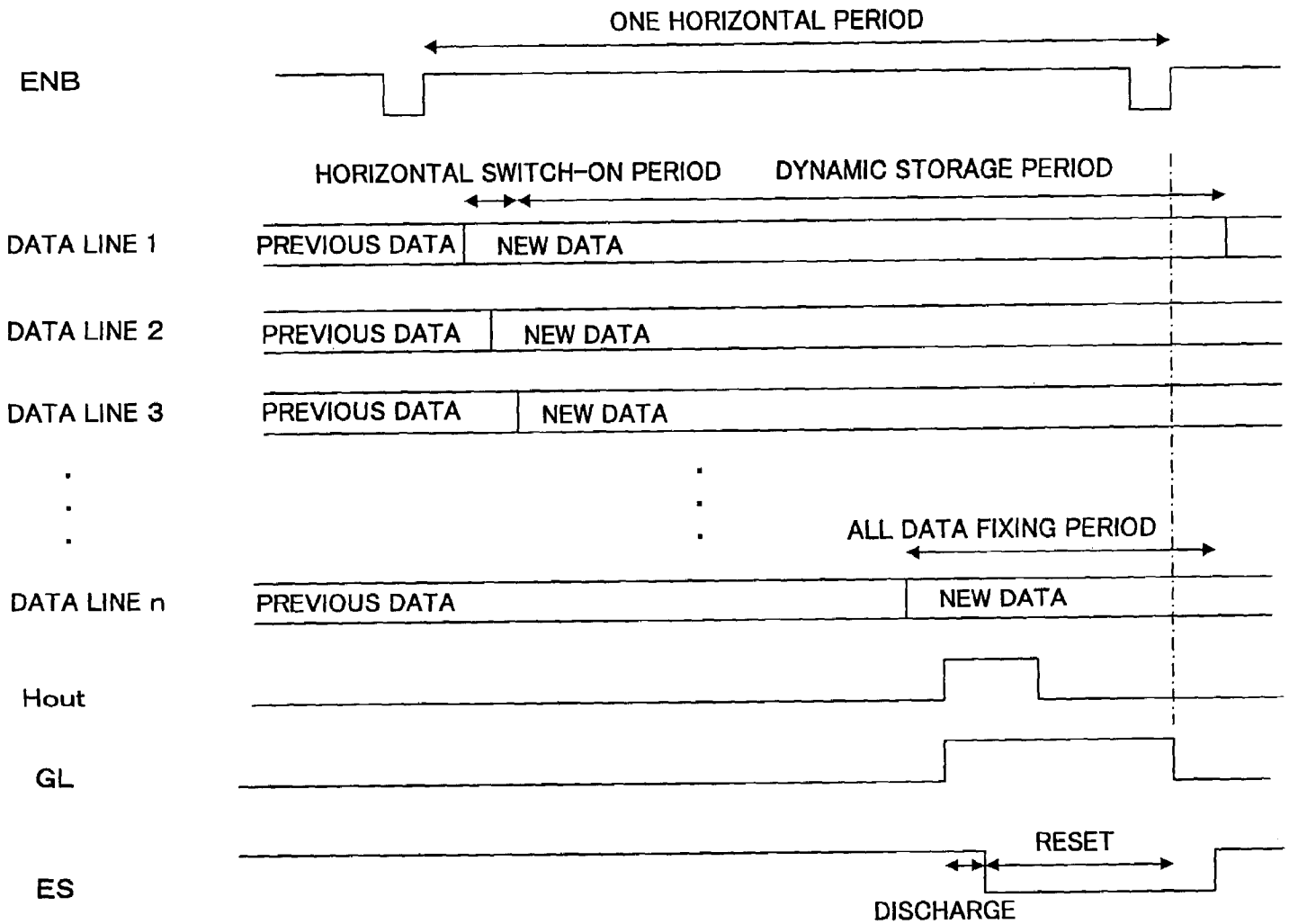
FIG. 9 is a diagram exemplifying timing for data setting.

A procedure for writing data to pixels on one horizontal line will now be described referring to FIG. 9.

After an L level of an enable signal ENB indicating the start of one horizontal period, the data voltages Vsig are written to all data lines DL in a point sequential manner. More specifically, a capacitor or the like is connected to the data line DL and a data signal Vsig is stored on the data line DL by setting a voltage signal. By sequentially setting the data voltage Vsig for the pixels of each column to the corresponding data line DL, the data voltage Vsig is set for all data lines DL.

When the setting of data is completed, Hout is set at the H level so that the gate line GL is set at the H level and activated, operations regarding the pixels along the horizontal direction as described above are performed, and data is written and light is emitted in each pixel.

In this manner, it is possible to sequentially write normal video signals (data voltages Vsig) on the data line DL, set the video signal in the pixel circuit, and cause light to be emitted.

Figure 10:
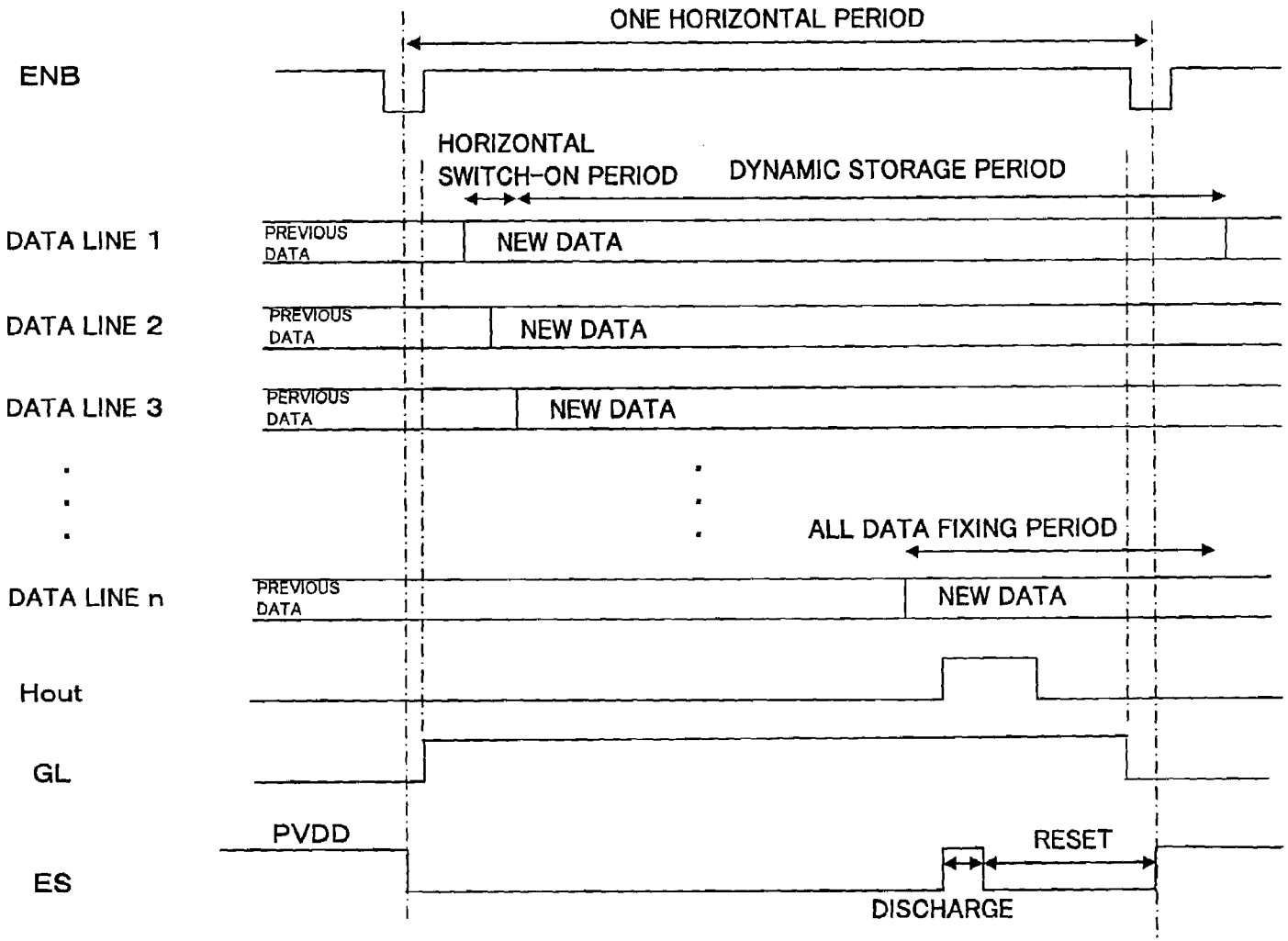
FIG. 10 is a diagram exemplifying different timing for data setting.

Next, another method will be described referring to FIG. 10. In this configuration, the emission set line ES is set to the L level during a period in which the enable line ENB is at the L level and the gate line GL is set to the H level (activated) during a rise of the enable line ENB to the H level. In this state, the data voltages Vsig are sequentially set to the data line DL. When data voltages Vsig are set on all data lines DL, the emission set line ES is set to the H level for discharge as described above, and then, the emission line ES is set back to the L level. The gate line GL returns to the L level in synchronization with the fall of the enable line ENB and the enable line ENB is set back to the H level during the period in which the enable line ENB is at the L level. With this configuration, operations similar to the above are performed.

Various alternative embodiments will now be described.

(A) First Alternative Embodiment

Figures 11, 12:
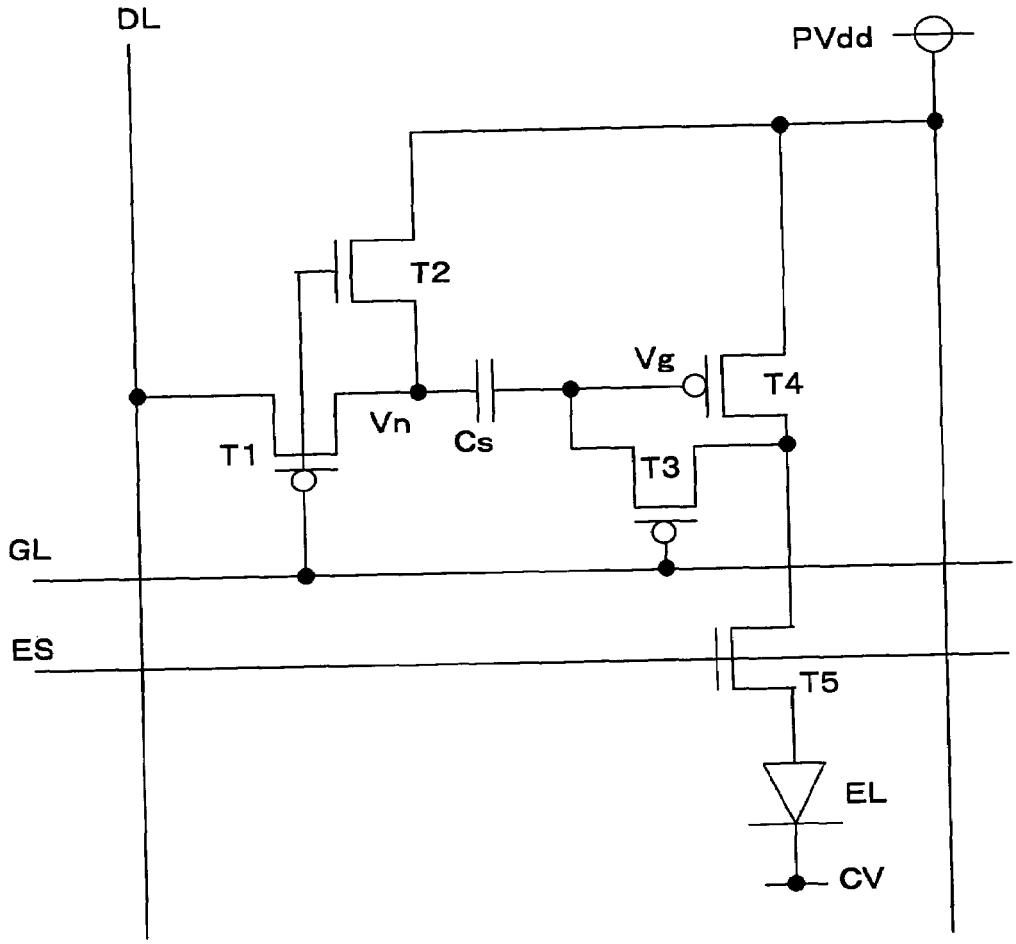
FIG. 11 is a diagram for explaining a structure according to a first alternative embodiment.
FIG. 12 is a diagram showing a drive state of the first alternative embodiment.

FIG. 11 shows a structure according to a first alternative embodiment of the present invention. In the first alternative embodiment, a p-channel transistor is employed for the selection transistor T1 and the short-circuiting transistor T3 and an n-channel transistor is employed as the potential controlling transistor T2. In this configuration, an operation similar to the above-described embodiment is enabled by inverting the H level and the L level of the gate line GL from the levels of the gate line GL in the above-described embodiment.

The on/off states of the selection transistor T1 and the drive controlling transistor T5 according to the control of the gate line GL and the emission set line ES are shown in FIG. 12, and are identical to those shown in FIG. 2.

(B) Second Alternative Embodiment

Figures 13, 14:
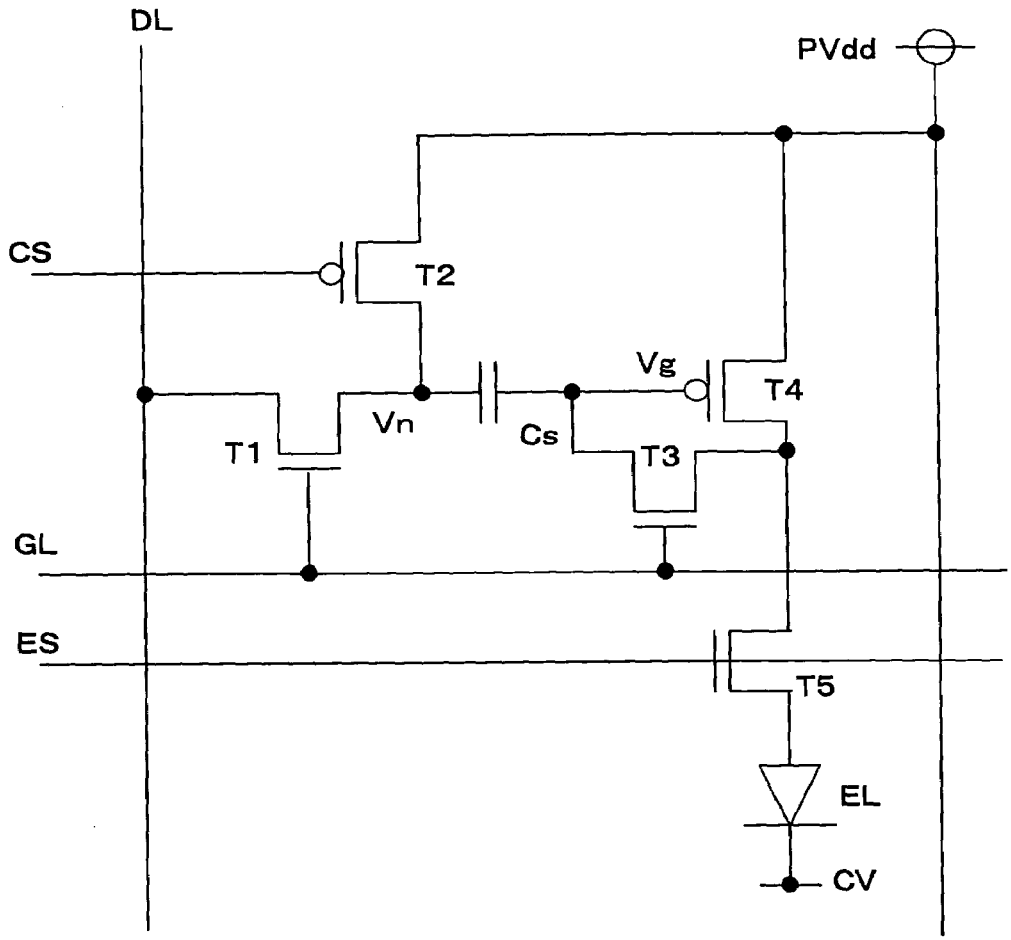
FIG. 13 is a diagram for explaining a structure according to a second alternative embodiment.
FIG. 14 is a diagram showing a drive state of the second alternative embodiment.

FIG. 13 shows a structure according to a second alternative embodiment of the present invention. In the second alternative embodiment, a dedicated control line CS is additionally provided for controlling the potential controlling transistor T2, compared to the pixel circuit of the above-described embodiment. Therefore, it is possible to independently control the potential controlling transistor T2 using the control line CS. As shown in FIG. 14, with the control line CS, it is possible to switch the potential controlling transistor T2 off before the selection transistor T1 is switched on and to switch the potential controlling transistor T2 on along with the drive controlling transistor T5 after the selection transistor T1 is switched off.

In this configuration, although a number of lines along the horizontal direction is increased, it is possible to switch the potential controlling transistor T2 on and off at an optimum timing. In other words, it is possible to reliably eliminate the period of simultaneous on states of the short-circuiting transistor T3 and the potential controlling transistor T2, which allows for accurate gate potential fixing and increase in correction precision.

Figure 15:
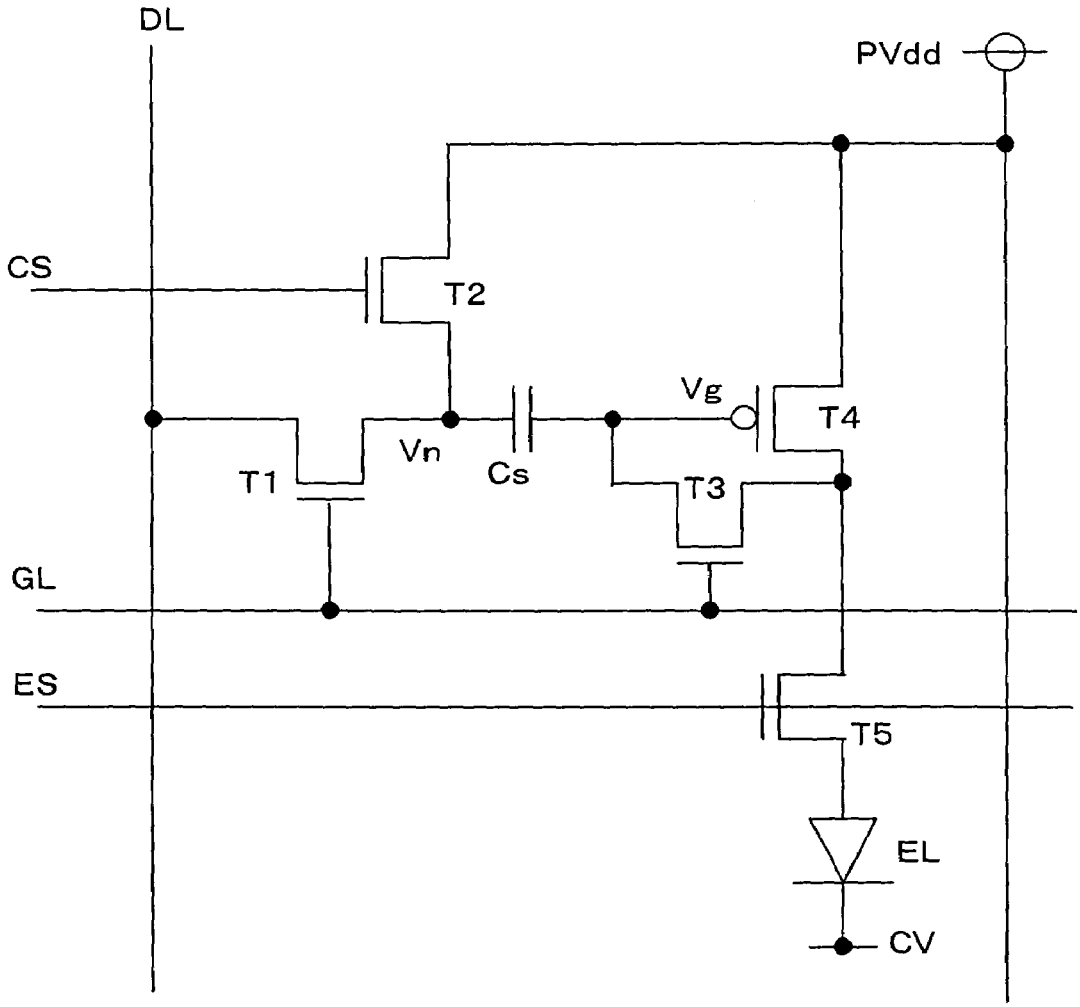
FIG. 15 is a diagram showing another structure according to the second alternative embodiment.
Figure 16:
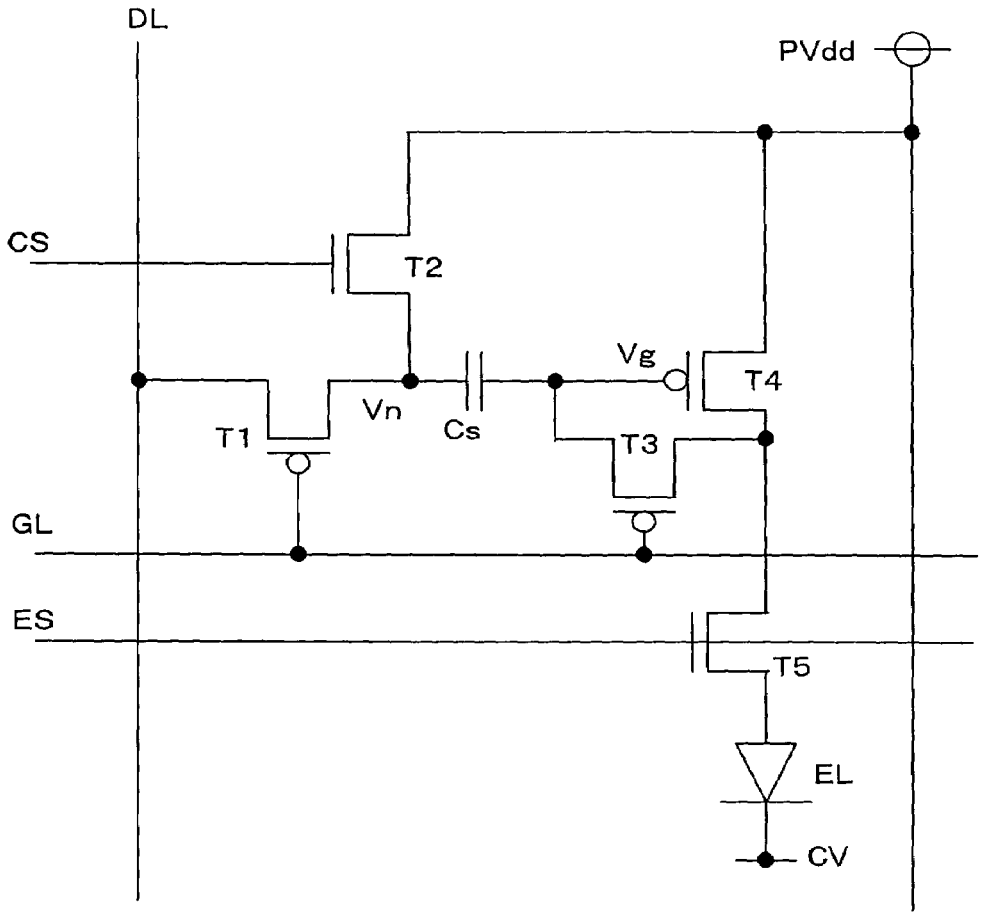
FIG. 16 is a diagram showing yet another structure according to the second alternative embodiment.
Figure 17:
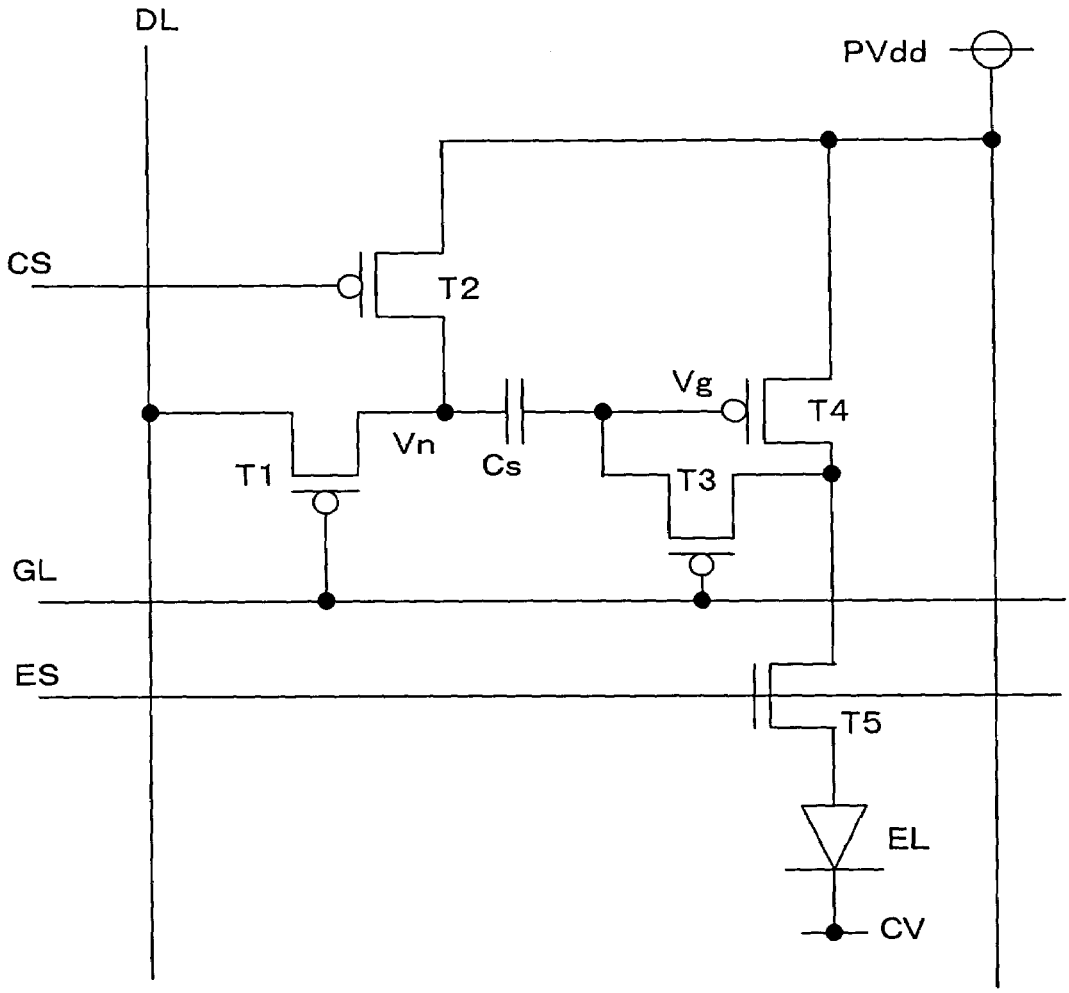
FIG. 17 is a diagram showing another structure according to the second alternative embodiment.

FIG. 15 shows an example configuration in which an n-channel transistor is employed for the potential controlling transistor T2 in FIG. 13, FIG. 16 shows an example configuration in which a p-channel transistor is employed for the selection transistor T1 and the short-circuiting transistor T3 and an n-channel transistor is employed for the potential controlling transistor T2, and FIG. 17 shows an example configuration in which a p-channel transistor is employed for all of the selection transistor T1, the short-circuiting transistor T3, and the potential controlling transistor T2.

(C) Third Alternative Embodiment

Figures 18, 19:
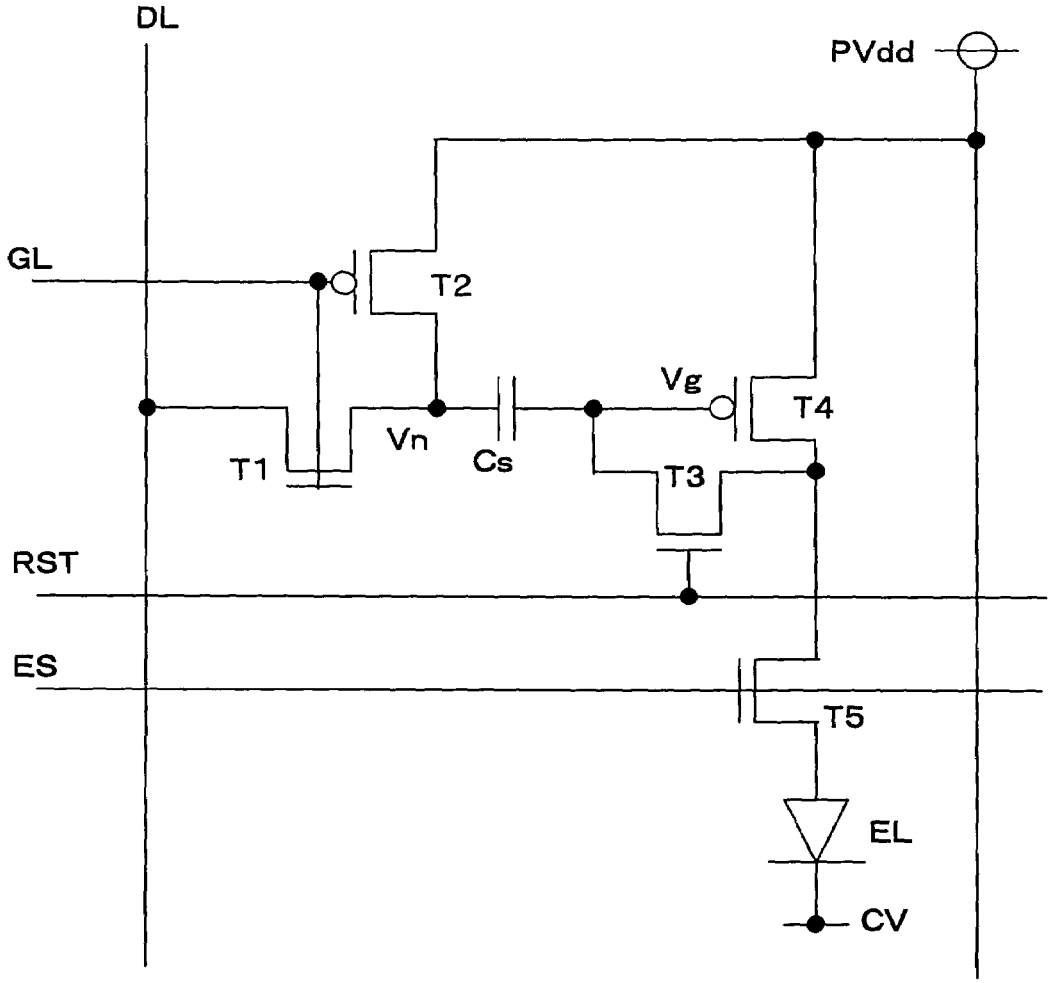
FIG. 18 is a diagram showing a structure according to a third alternative embodiment.
FIG. 19 is a diagram showing a drive state of the third alternative embodiment.

FIG. 18 shows another alternative embodiment of the present invention in which the selection transistor T1 and the potential controlling transistor T2 are connected to the gate line GL, a dedicated reset line RST is provided, and the short-circuiting transistor T3 is connected to the reset line RST. In this configuration, as shown in FIG. 19, the short-circuiting transistor T3 can be switched off using the reset line RST before the selection transistor T1 is switched off and the drive controlling transistor T5 is switched on.

Therefore, similar to the second alternative embodiment, it is possible to eliminate the period in which the potential controlling transistor T2 and the short-circuiting transistor T3 are simultaneously in the on state. With this structure, only two transistors, one being the selection transistor T1 and the other being the potential controlling transistor T2, need be provided near the gate line GL, which allows for easier layout of the transistors in the pixel circuit. However, in this configuration, the timing for the switching off of the selection transistor T1 and the timing for the switching off of the short-circuiting transistor T3 are not identical, and noise may be generated which affects Vg.

(D) Fourth Alternative Embodiment

Figures 20, 21:
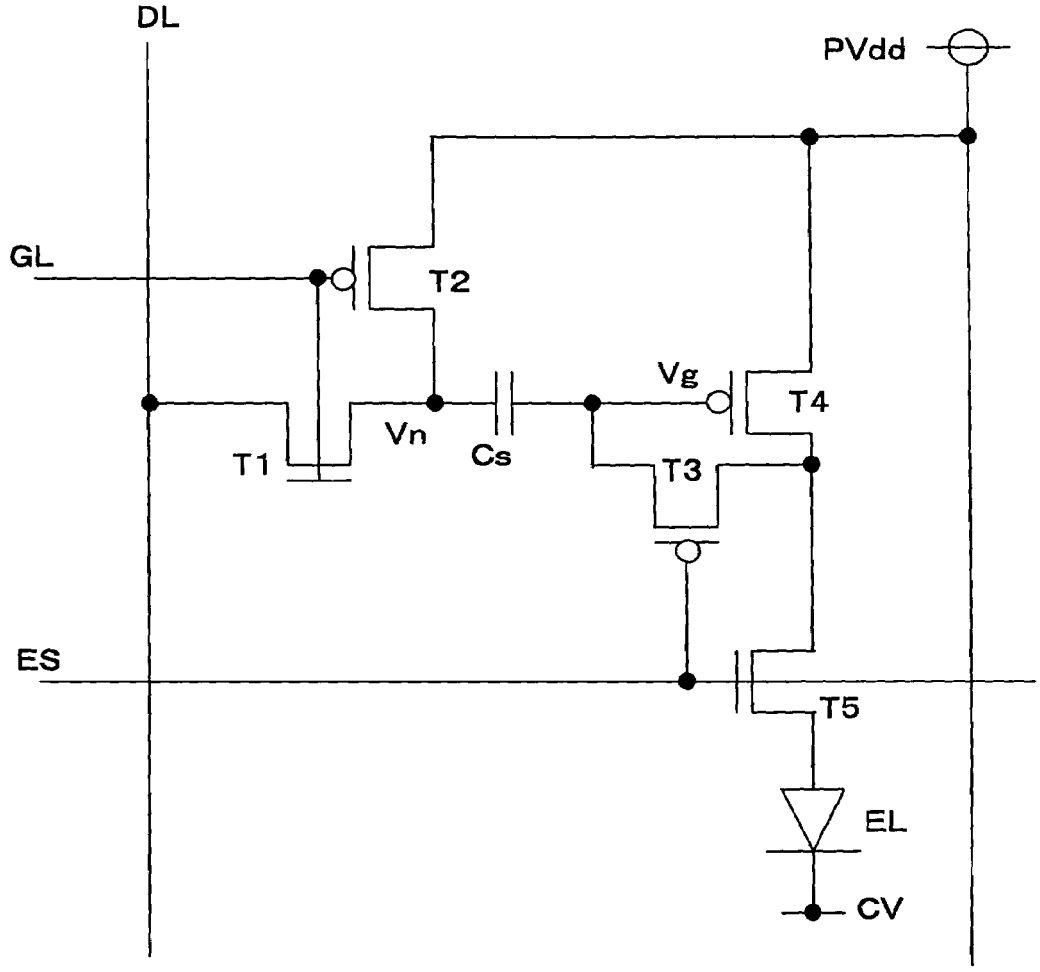
FIG. 20 is a diagram showing a structure according to a fourth alternative embodiment.
FIG. 21 is a diagram showing a drive state of the fourth alternative embodiment.

FIG. 20 shows yet another alternative embodiment of the present invention in which the selection transistor T1 and the potential controlling transistor T2 are connected to the gate line GL and the short-circuiting transistor T3 and the drive controlling transistor T5 are connected to the emission set line ES. In this example configuration, as shown in FIG. 21, from the state of light emission, the gate line GL becomes H level so that the potential controlling transistor T2 is switched off, the selection transistor T1 is switched on, and the data voltage Vsig is supplied to one terminal of the capacitor Cs. In this process, the short-circuiting transistor T3 is in the off state and the drive controlling transistor T5 is in the on state. Then, the emission set line ES becomes L level so that the short-circuiting transistor T3 is switched on and the drive controlling transistor T5 is switched off. A current flows through the organic EL element EL until the time immediately before this process, and therefore the drain of the driver transistor T4 is at a relatively low voltage. As a result of the short-circuiting transistor T3 being switched on, Vg is set to the value of PVdd+Vtp, to achieve the reset process. Then, when the emission set line ES becomes H level so that the short-circuiting transistor T3 is switched off and the drive controlling transistor T5 is switched on, the gate line GL is set to H level so that the potential is fixed and light is emitted.

According to the fourth alternative embodiment, placement of lines becomes very easy by placing the selection transistor T1 and the potential controlling transistor T2 near the gate line GL and the short-circuiting transistor T3 and the drive controlling transistor T5 near the emission set line ES. Therefore, this configuration allows for an easier layout in the pixel circuit. However, because the timing of the selection transistor T1 is shifted from the timing of the short-circuiting transistor T3, there is also a disadvantage that the configuration tends to be affected by noise. In addition, because no discharge process as provided in the other configurations can be provided, discharge of charges on the gate of the driver transistor T4 may be insufficient in many cases.

(E) Fifth Alternative Embodiment

Figure 22:
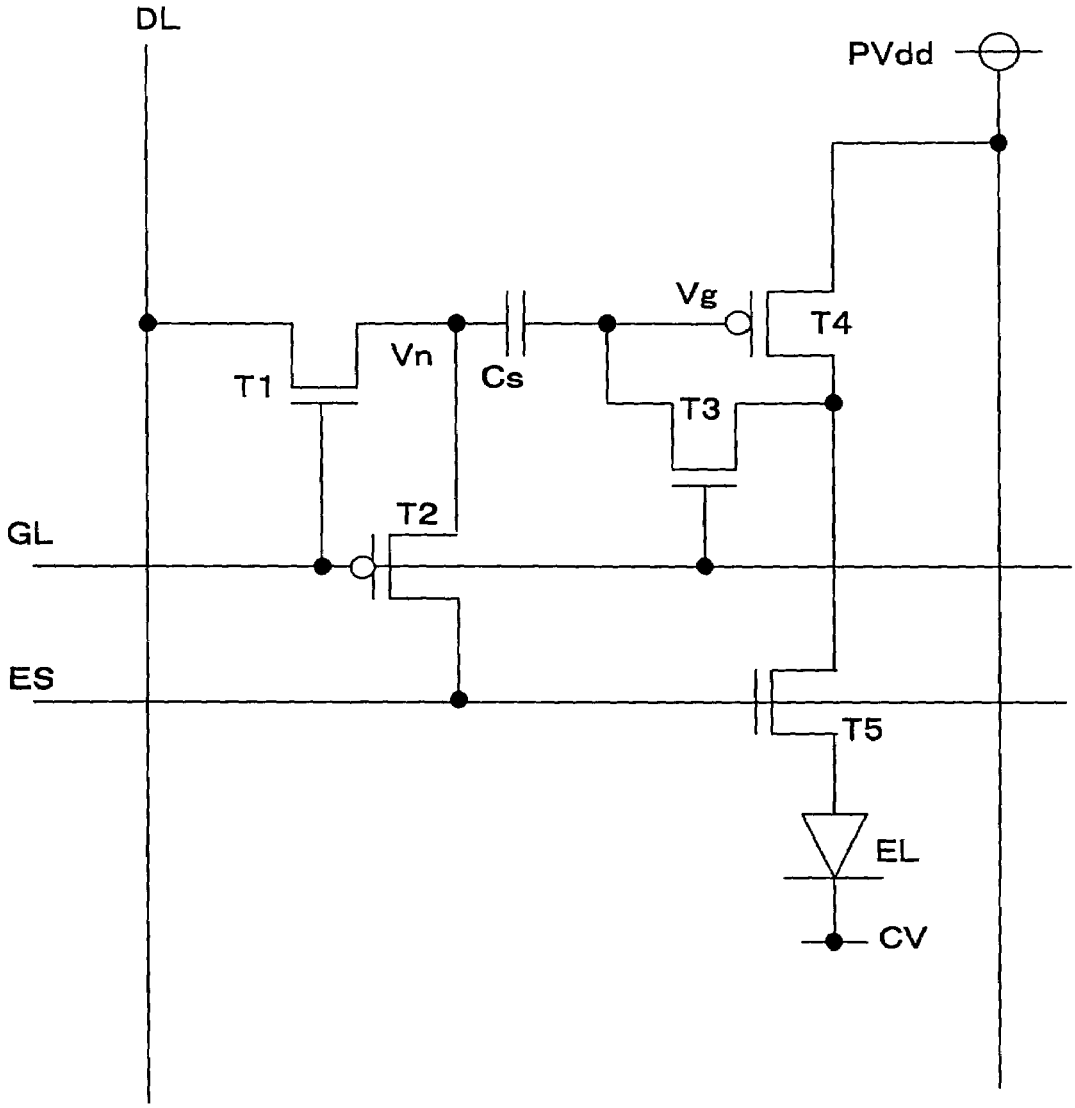
FIG. 22 is a diagram showing a structure of a pixel circuit according to a fifth alternative embodiment.

FIG. 22 shows another alternative embodiment in which the potential controlling transistor T2 is connected to the emission set line ES and not to the power supply PVdd. That is, in the above-described embodiment, the terminal of the capacitor Cs on the side of the selection transistor T1 is connected to the power supply PVdd by the potential controlling transistor T2, but in this alternative embodiment, the terminal of the capacitor Cs on the side of the selection transistor T1 is connected to the emission set line ES by the potential controlling transistor T2. The emission set line ES is set to VVBB during the L level and to PVdd during H level. Therefore, in this circuit also, operations similar to the above-described circuit can be obtained. In order to achieve the operations as described above, the line to which the potential controlling transistor T2 connects the terminal of the capacitor Cs on the side of the selection transistor T1 may be different from the power supply PVdd. In other words, the potential controlling transistor T2 may connect the terminal of the capacitor Cs on the side of the selection transistor T1 to a power supply of another voltage as long as a suitable amount of shift can be obtained regarding the driver transistor T4.

The states in the fifth alternative embodiment will now be described.

(i) Discharge (GL=H and ES=H)

Figure 23:
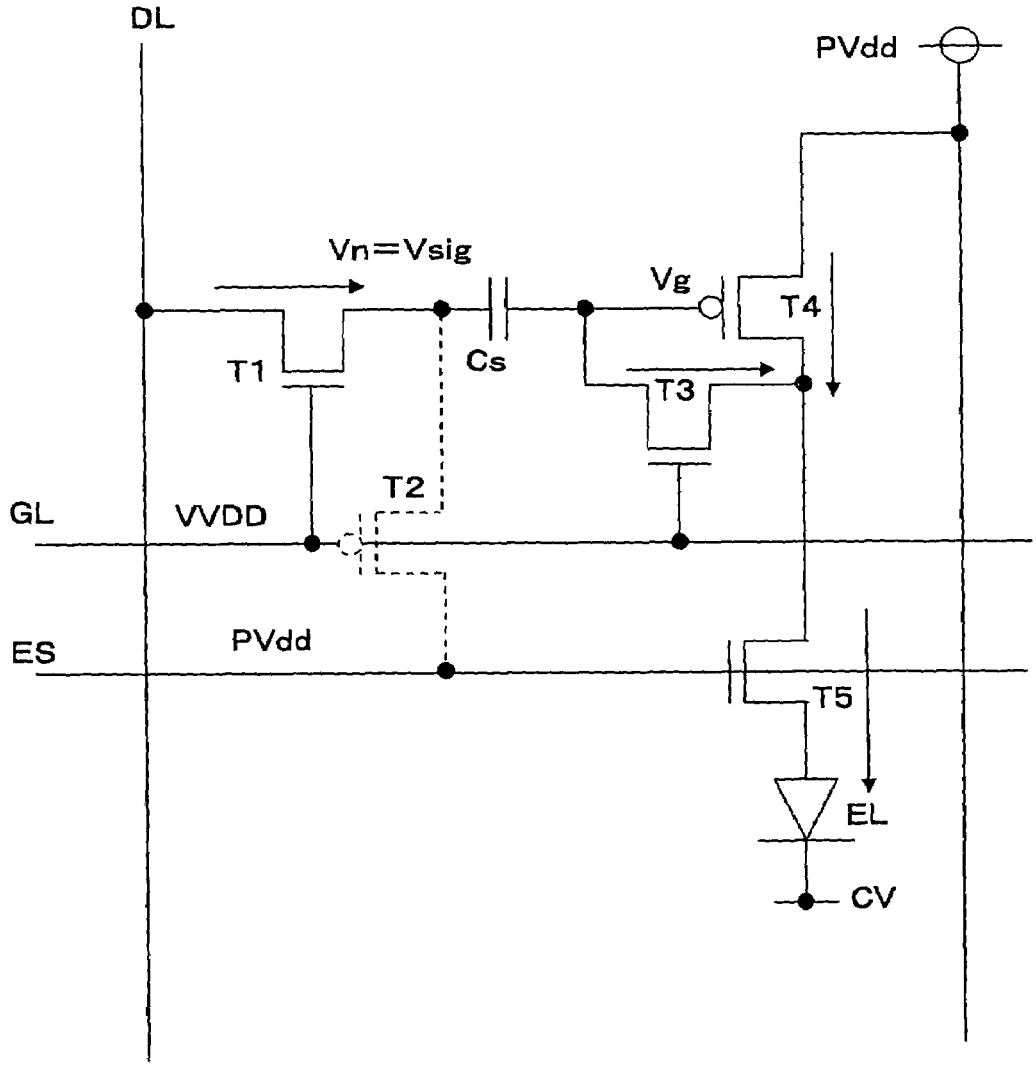
FIG. 23 is a diagram for explaining a discharge step in the fifth alternative embodiment.

While the data voltage Vsig is supplied on the data line DL, the gate line GL and the emission set line ES are both set to H level (high level). With this operation, the selection transistor T1, the drive controlling transistor T5, and the short-circuiting transistor T3 are switched on and the potential controlling transistor T2 is switched off. Therefore, as shown in FIG. 23, a current is supplied from the power supply line PVdd through the driver transistor T4, the drive controlling transistor T5, and the organic EL element EL to the cathode power supply CV while the voltage Vn on a terminal of the capacitor Cs on the side of the selection transistor T1 is set at Vsig. With this process, the charges stored on the gate of the driver transistor T4 are withdrawn and the gate voltage Vg of the driver transistor T4 is set to a predetermined low voltage.

(ii) Reset (GL=H and ES=L)

Figure 24:
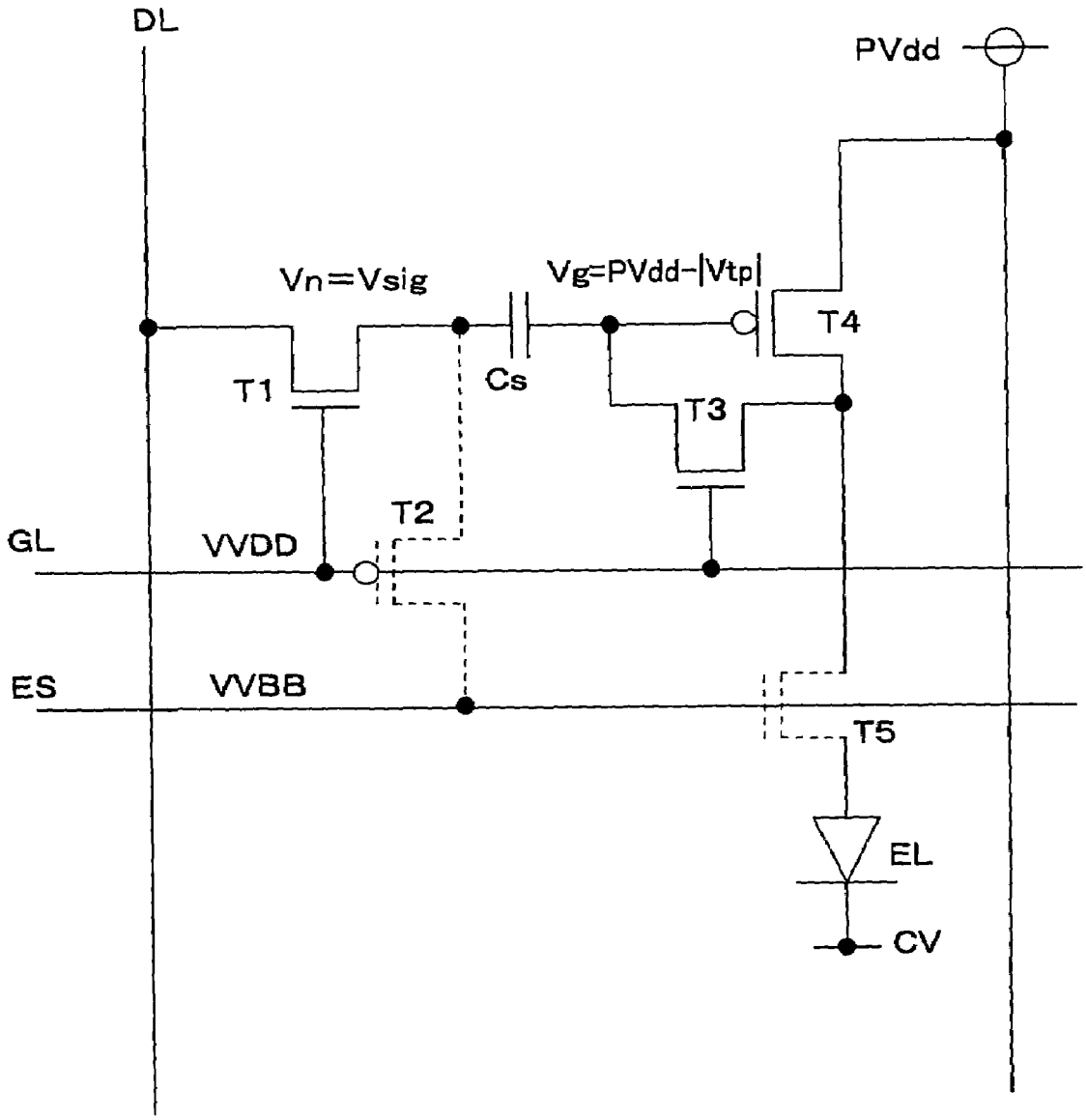
FIG. 24 is a diagram for explaining a reset step in the fifth alternative embodiment.

From the above-described discharge state, the emission set line ES is changed to L level (low level). With this process, the drive controlling transistor T5 is switched off as shown in FIG. 24 and the gate voltage Vg of the driver transistor T4 is reset to Vg0=PVdd−|Vtp|. The voltage Vtp is the threshold voltage of the driver transistor T4. In other words, because the gate and the drain of the driver transistor T4 are connected (short-circuited) by the short-circuiting transistor T3 while the source of the driver transistor T4 is connected to the power supply PVdd, the gate voltage of the driver transistor T4 is set to a voltage which is lower than the power supply PVdd by the threshold voltage |Vtp| of the driver transistor T4 and the driver transistor T4 is switched off. In this process, the potential Vn of the capacitor Cs on the terminal on the side of the selection transistor T1 is Vsig and a voltage of |Vsig−(PVdd−|Vtp|)| is charged to the capacitor Cs.

(iii) Potential Fixing (GL=L and ES=L)

Next, the gate line GL is changed to the L level so that the selection transistor T1 and the short-circuiting transistor T3 are switched off and the potential controlling transistor T2 is switched on. In this process, the voltage on the emission set line ES is at L level and is set to a voltage identical to the voltage VVBB of L level of the gate line GL. Therefore, Vsig>Vn>VVBB, and the potential controlling transistor T2 is not switched on unless the selection transistor T1 is switched off. In this manner, because the potential controlling transistor T2 is switched on after the selection transistor T1 is switched off, the voltage stored in the capacitor Cs is maintained and the data voltage is not destroyed.

Figure 25:
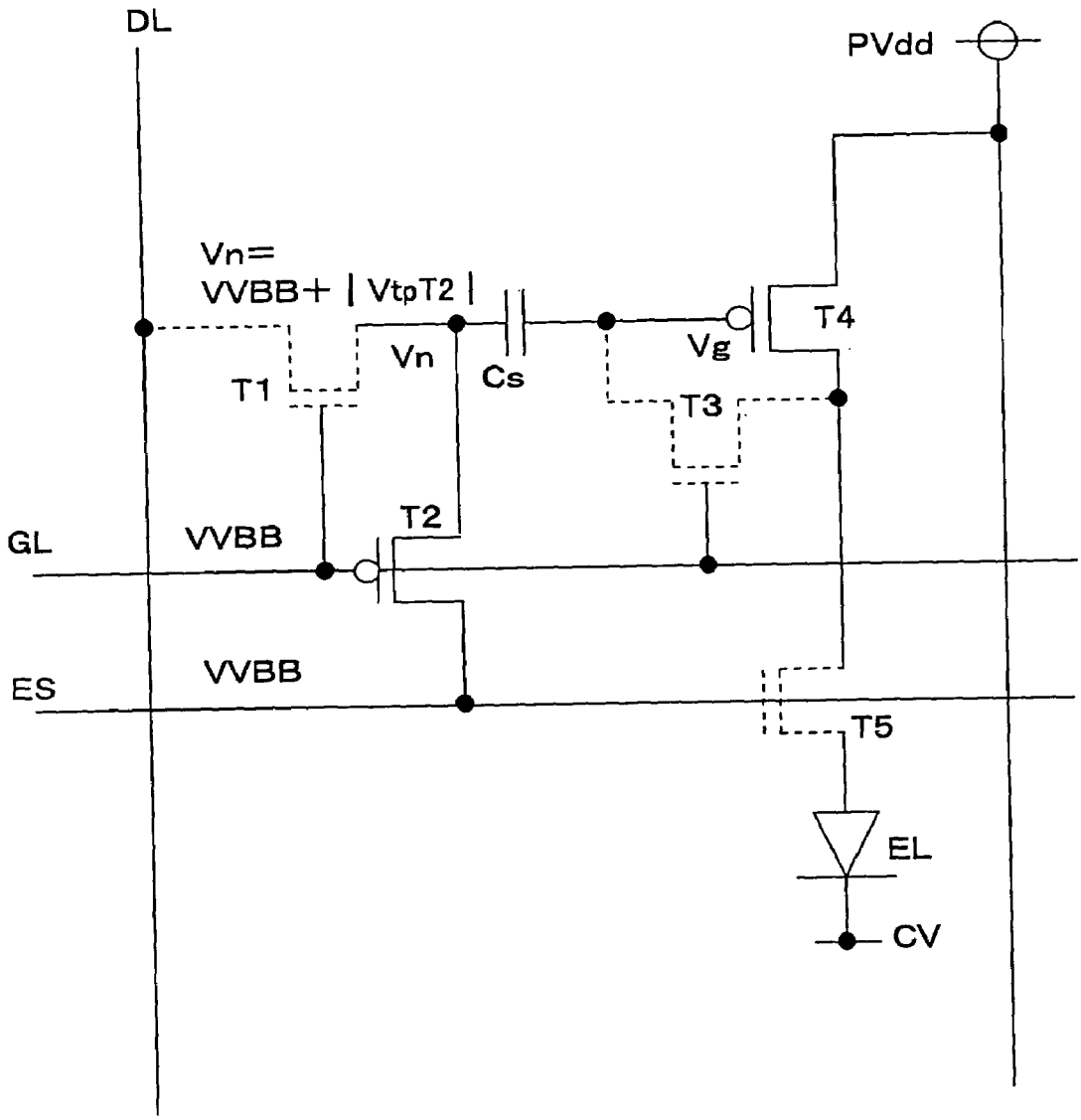
FIG. 25 is a diagram for explaining a potential fixing step in the fifth alternative embodiment.

As shown in FIG. 25, with the selection transistor T1 being switched off and the potential controlling transistor T2 being switched on, the gate of the driver transistor T4 is separated from the drain and, with the potential controlling transistor T2 being switched on, the voltage Vn is set to the voltage VVBB+|VtpT2| of the emission set line ES.

(iv) Light Emission (GL=L and ES=H)

Figure 26:
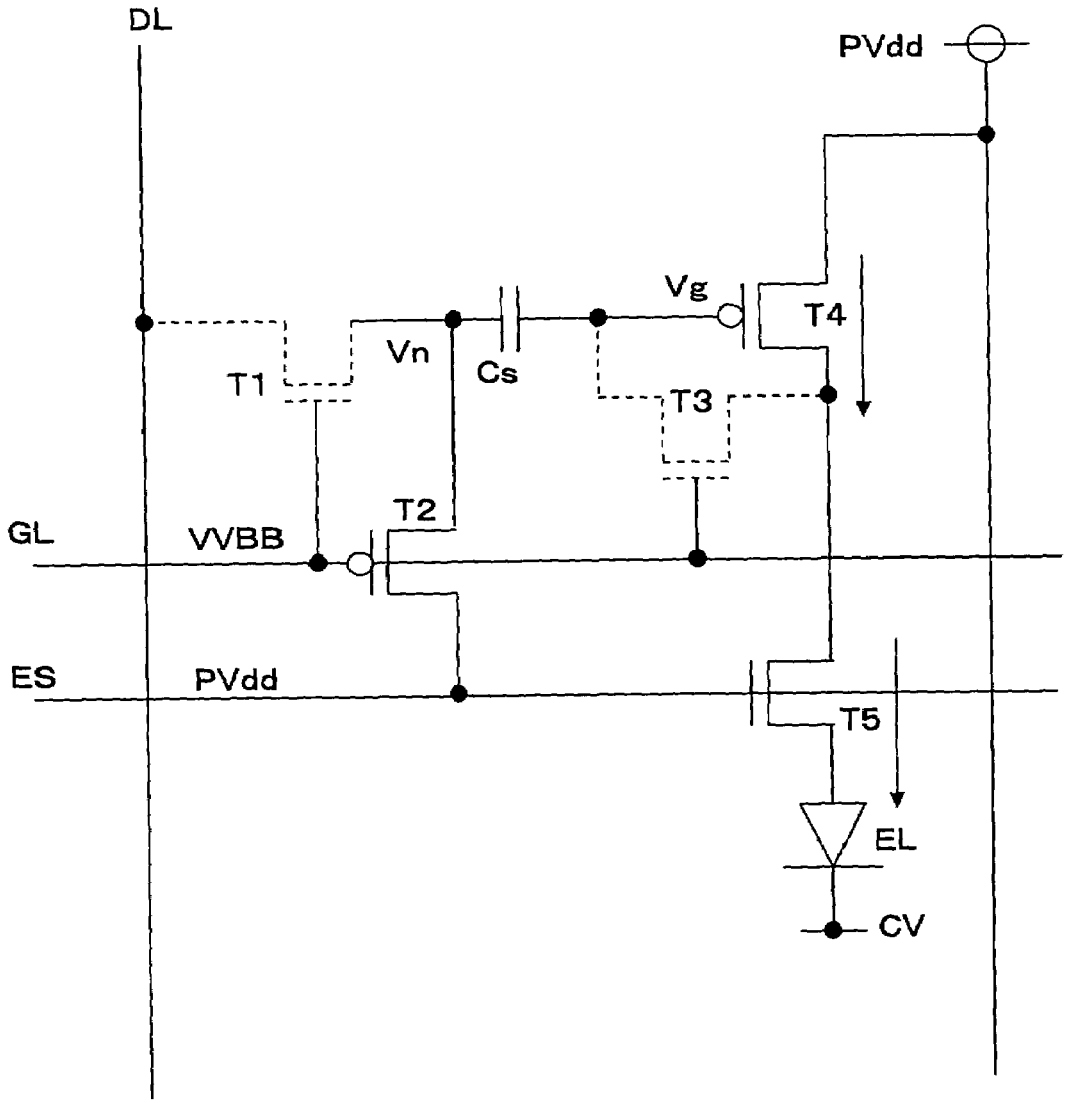
FIG. 26 is a diagram for explaining a light emission step in the fifth alternative embodiment.

Next, the emission set line ES is set to H level so that the drive controlling transistor T5 is switched on as shown in FIG. 26. Because the potential on the emission set line ES is set to PVdd, the gate potential of the driver transistor T4 is shifted by an amount of PVdd−VVBB+|VtpT2|. The amount of voltage shift in this process is affected by the gate capacitance Cp of the driver transistor T4.

When the voltage is shifted and the drive controlling transistor T5 is switched on, a drive current flows from the driver transistor T4 to the organic EL element EL. The drive current in this process is the drain current of the driver transistor T4 determined by the gate voltage of the driver transistor T4 and is independent from the threshold voltage Vtp of the driver transistor T4. Therefore, it is possible to inhibit variation in the amount of light emission due to variation in the threshold voltages.

The drain of the potential controlling transistor T2 is connected to the emission set line ES. The emission line ES is set to the power supply voltage PVdd during the H level, but is supplied with the power supply voltage PVdd independent from the power supply line PVdd for supplying current to the organic EL element EL. Therefore, the voltage of the emission set line ES substantially does not change due to the drive current of the organic EL element EL in each pixel, and it is thus possible to prevent disturbance in display caused by a change in the shifting voltage being supplied to one terminal of the capacitor Cs through the potential controlling transistor T2.

For example, the amount of voltage shift ΔVg is represented as ΔVg=Cs(Vsig−PVdd)/(Cs+Cp) as will be described later and this representation contains PVdd. Therefore, when PVdd changes, ΔVg also changes, but this change is inhibited in this alternative embodiment. In particular, when the number of pixels is increased, the change in PVdd causes crosstalk and brightness gradient. According to the fifth alternative embodiment, these influences can be inhibited.

(F) Sixth Alternative Embodiment

Figure 27:
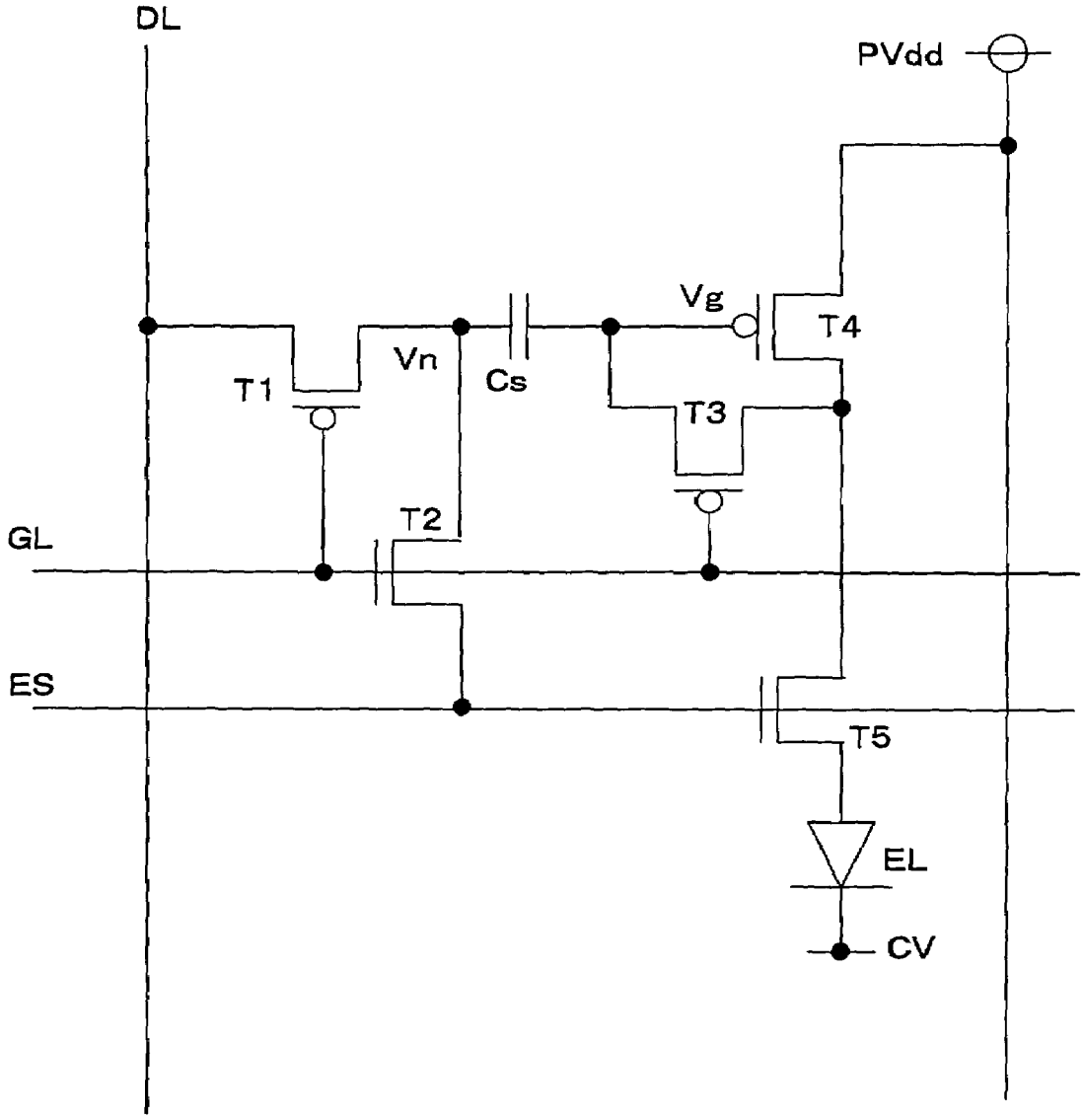
FIG. 27 is a diagram for explaining a structure according to a sixth alternative embodiment.

FIG. 27 shows a structure according to a sixth alternative embodiment of the present invention. This embodiment is basically identical to the fifth alternative embodiment except that a p-channel transistor is employed for the selection transistor T1 and short-circuiting transistor T3 and an n-channel transistor is employed for the potential controlling transistor T2. In this configuration, operation similar to the above-described embodiment is achieved by inverting the H and L levels on the gate line GL from those in the fifth alternative embodiment.

(G) Seventh Alternative Embodiment

Figure 28:
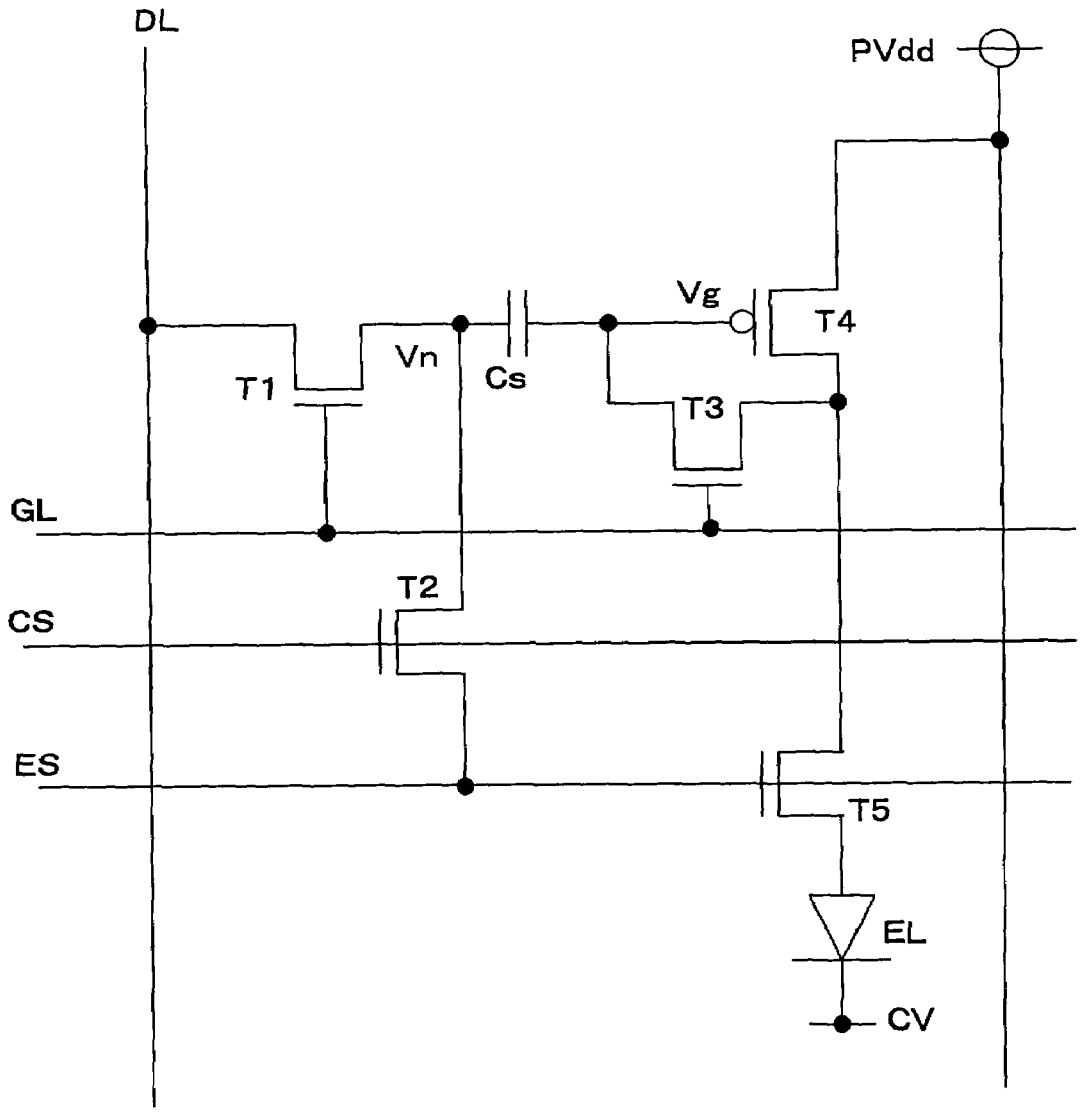
FIG. 28 is a diagram showing a structure of a pixel circuit according to a seventh alternative embodiment.
Figure 29:
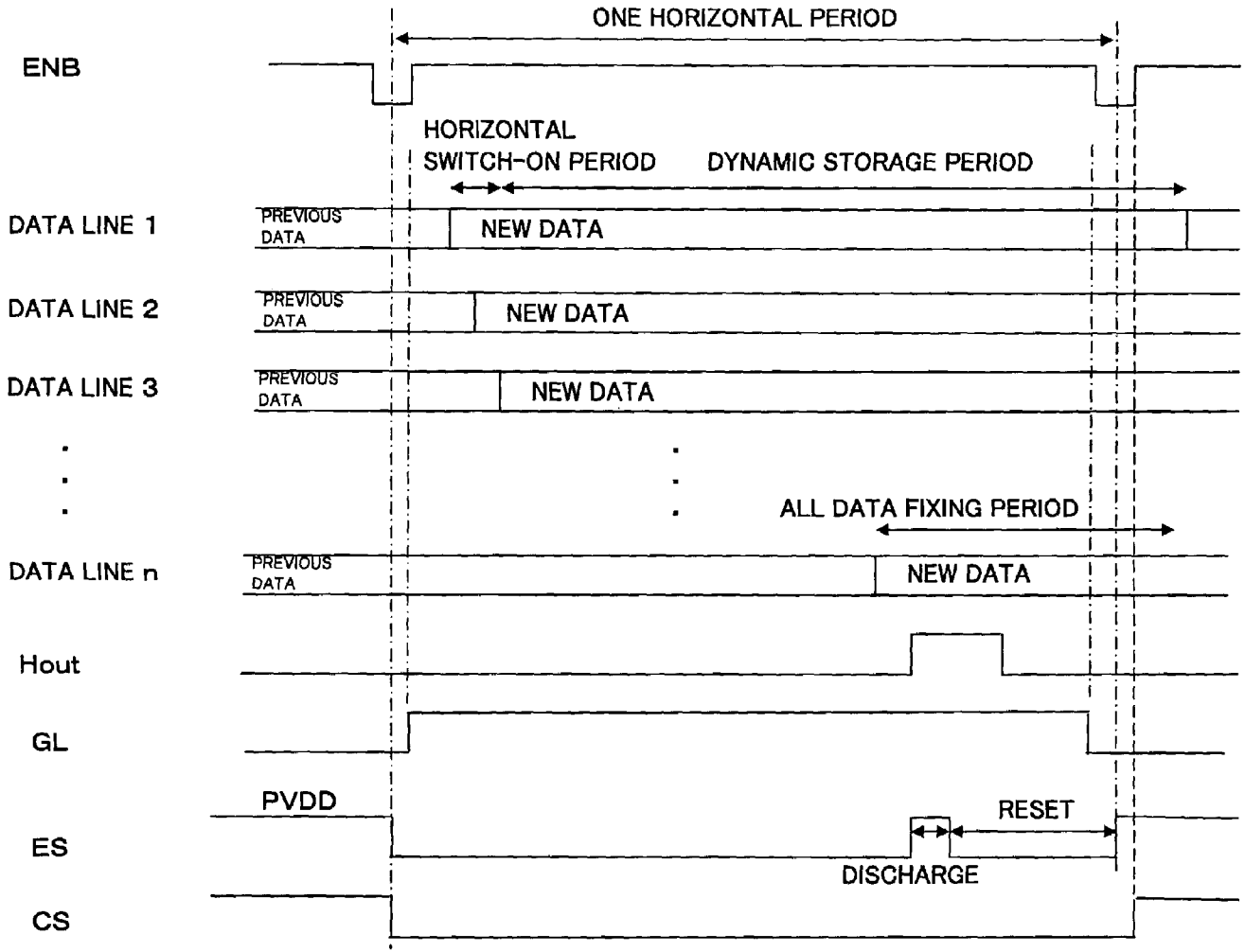
FIG. 29 is a chart for explaining an operation of the seventh alternative embodiment.

FIG. 28 shows a structure according to a seventh alternative embodiment of the present invention. In the seventh alternative embodiment, a capacitance set line SC is connected to the gate of the potential controlling transistor T2 and an n-channel transistor is employed for the potential controlling transistor T2. As described, in the seventh alternative embodiment, a capacitance set line CS is provided which is a dedicated line for switching the potential controlling transistor T2 on and off. By setting the capacitance set line CS to VVDD at an H level and VVBB at a L level as shown in FIG. 29, it is possible to prevent a temporal drop of the level of the Vn. More specifically, in the embodiment shown on FIG. 22, etc., the gate line GL and the capacitance set line CS are common, and, thus, the gate line GL must be set to the L level at the timing of the L level of the emission set line ES and Vn changes from Vsig to VVBB+|VtpT2| to PVDD. In the seventh alterative embodiment, on the other hand, because the timings for the gate line GL, capacitance set line CS, and emission set line ES can be determined independently from each other, it is possible to set the capacitance set line CS to the H level after the emission set line ES is set to the H level as shown in FIG. 29 so that the voltage Vn directly changes to PVDD without the temporal drop, resulting in a more stable operation.

In the embodiment, it is preferable to set the various voltages in the following manner. The power supply line PVdd is preferably set at PVdd, the emission set line ES is preferably set at PVdd at the H level and VVBB at the L level, the gate line GL is preferably set to VVDD at the H level and VVBB at the L level, the capacitance set line Cs is preferably set to VVDD at the H level and VVBB at the L level, and the cathode power supply CV is preferably set to CV, wherein the voltage PVdd is set at 8 V, the voltage VVDD is set at 10 V, the voltage VVBB is set at −2 V, and the voltage CV is set at −2 V.

(H) Eighth Alternative Embodiment

Figure 30:
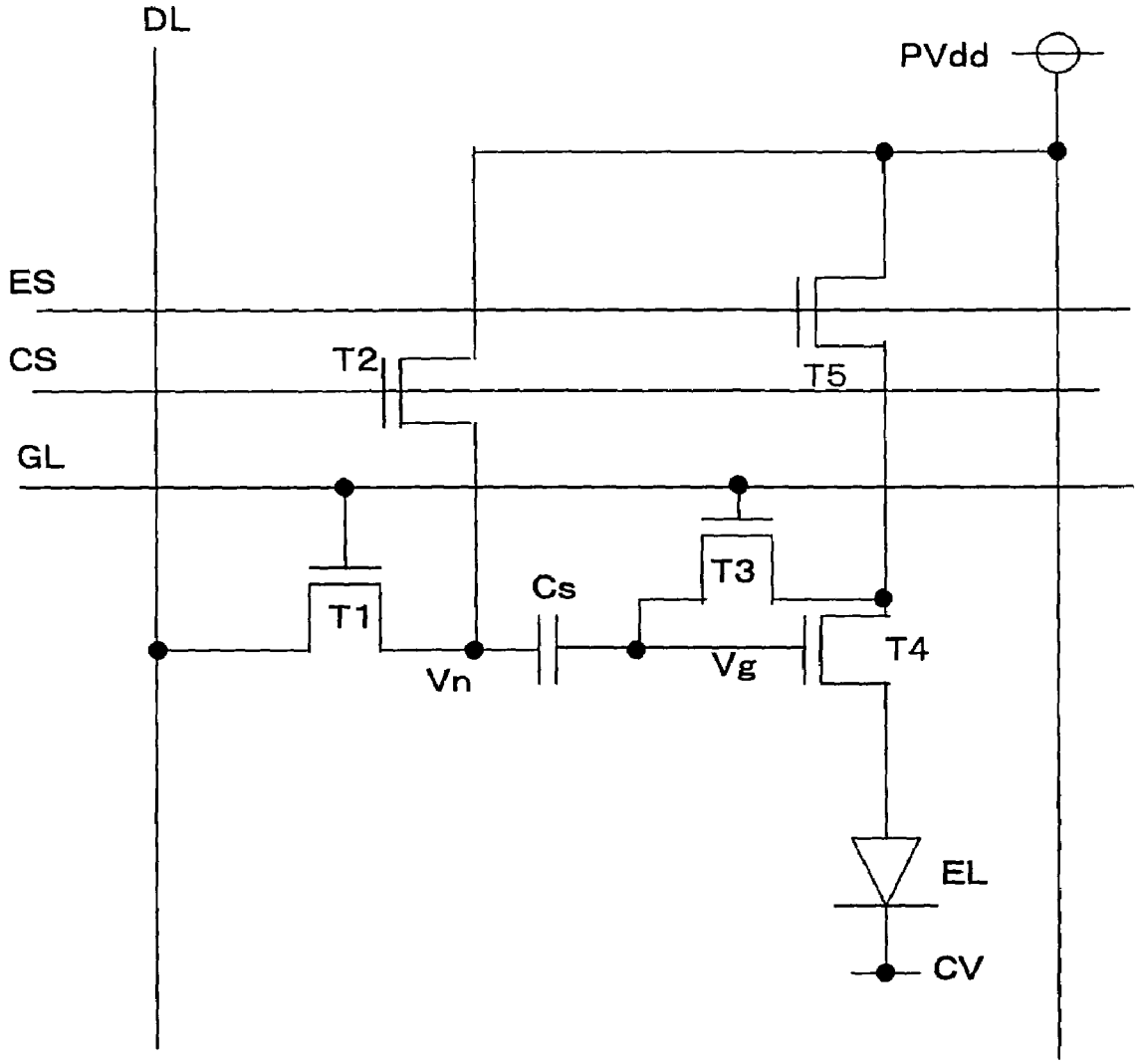
FIG. 30 is a diagram showing a structure of a pixel circuit according to an eighth alternative embodiment.

In an eighth alternative embodiment, an n-channel transistor is employed for the driver transistor T4 as shown in FIG. 30. The source of the driver transistor T4 is connected to the anode of the organic EL element EL, the drain of the driver transistor T4 is connected to the source of an n-channel drive controlling transistor T5, and the drain of the drive controlling transistor T5 is connected to the power supply PVdd.

A capacitance set line CS is provided extending along the horizontal direction similar to the gate line GL and a gate of an n-channel potential controlling transistor T2 is connected to the capacitance set line CS.

The other structures are similar to those of the circuit of FIG. 1.

Operation of this pixel circuit will now be described.

Figure 31:
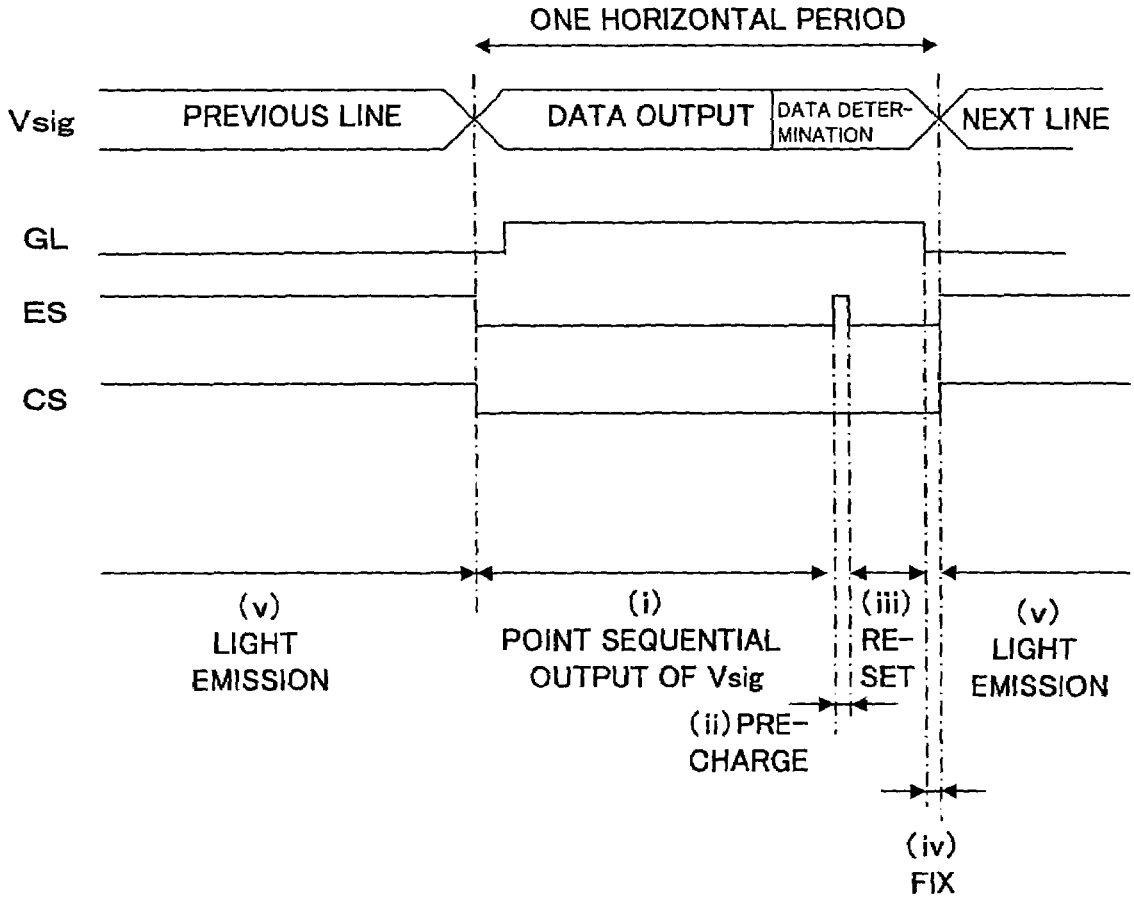
FIG. 31 is a chart for explaining an operation of the eighth alternative embodiment.

As shown in FIG. 31, the pixel circuit (including the data line DL) has five states within one horizontal period depending on the states (H and L levels) of the gate line GL, emission set line ES, and capacitance set line CS, and these states are repeated. That is, the pixel circuit has (i) a data set state in which GL is at the H level, ES is at the L level, and CS is at the L level, (ii) a pre-charge state in which GL is at the H level, ES is at the H level, and CS is at the L level, (iii) a reset state in which GL is at the H level, ES is at the L level, and CS is at the L level, (iv) a potential fixing state in which GL is at the L level, ES is at the L level, and CS is at the L level, and (v) a light emission state in which GL is at the L level, ES is at the H level, and CS is at the H level.

As shown in the figure, the data on the data line DL is sequentially set on the data line DL on each column of a horizontal line when the horizontal line to which data is to be written is selected. In other words, for the data line DL, data is output for each pixel in a point sequential manner. After the data is set in all data lines DL, the data (data voltage) is read into each pixel.

A write operation will now be described.

(i) Data Set (GL=H, ES=L, and CS=L)

First, the emission set line ES is set to the L level so that current from the power supply line PVdd is blocked and the capacitance set line CS is set at the L level so that a voltage at a connection point between the selection transistor T1 and the capacitor Cs is reduced. In this state, the gate line GL is set to the H level and the data voltages for pixels corresponding to the data line DL are sequentially set. Therefore, the voltage set on the data line DL is applied to the capacitor Cs. The data voltages are set on the data line DL in a point sequential manner, and because a capacitance is connected to each data line DL, the data voltage which has been applied is stored.

(ii) Pre-Charge (GL=H, ES=H, and CS=L)

After data setting to each data line DL is completed, the emission set line ES is set to the H level. With this process, the drain of the driver transistor T4 is connected to the power supply line PVdd, and because the short-circuiting transistor T3 is still switched on, the gate of the driver transistor T4 is charged to the power supply potential PVdd.

(iii) Reset (GL=H, ES=L, and CS=L)

Then, the emission set line ES is returned to the L level so that the driver transistor T4 is separated from the power supply PVdd. With this process the gate potential of the driver transistor T4 is reduced to a potential having an offset of a threshold voltage Vtn from the source potential. On the other hand, because the source potential becomes the threshold voltage Ve of the organic EL element EL, the gate voltage Vg of the driver transistor T4 becomes Ve+Vtn. The terminal of the capacitor Cs on the side of the data line DL is at the data voltage Vsig of the data line DL.

(iv) Potential Fixing (GL=L, ES=L, and CS=L)

Figure 32:
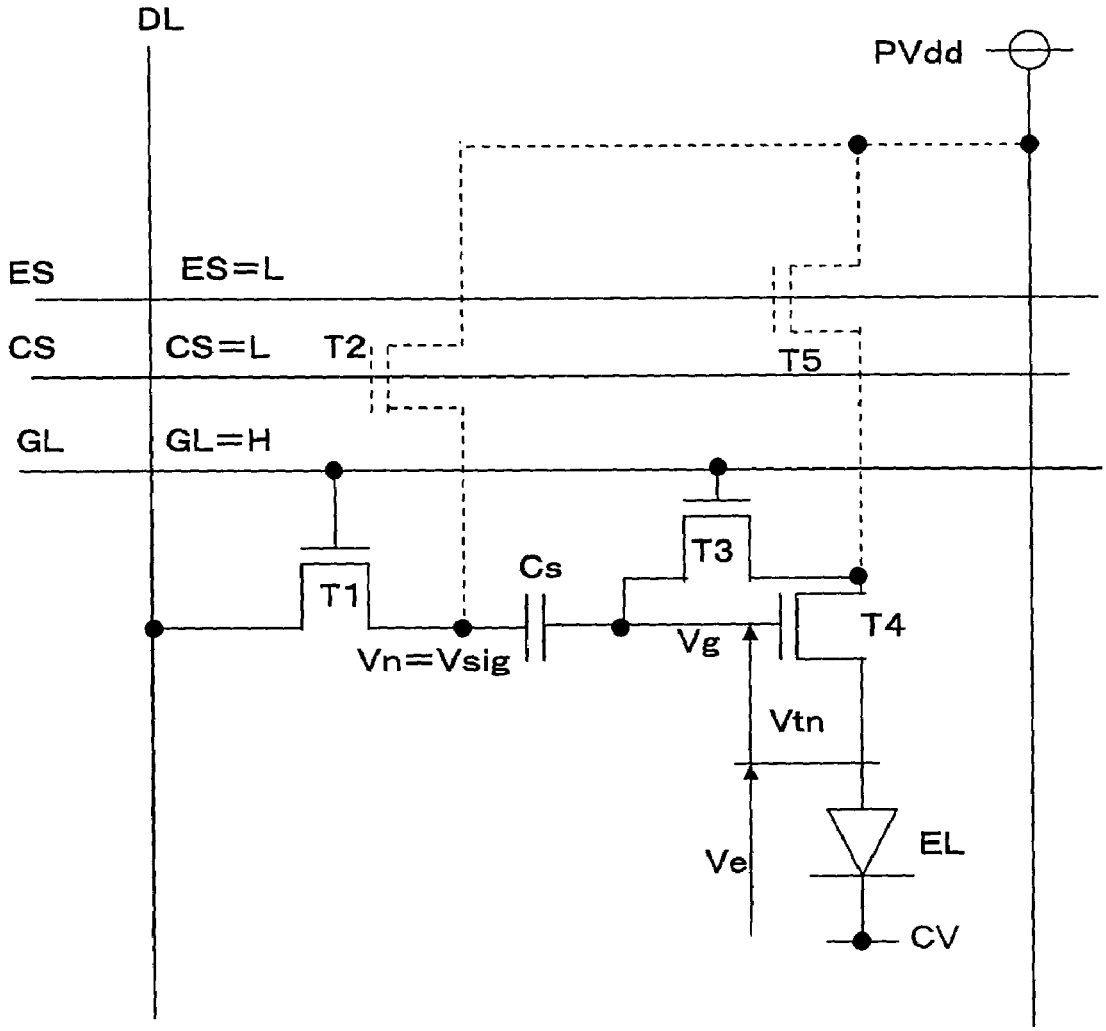
FIG. 32 is a diagram for explaining writing of data in the eighth alternative embodiment.

Next, the gate line GL is set to the L level so that the selection transistor T1 and the short-circuiting transistor T3 are switched off. With this process, as shown in FIG. 32, the gate voltage Vg of the driver transistor T4 is fixed at Ve+Vtn. The voltage on the opposing terminal of the capacitor Cs is at Vsig, and as a result a voltage of Vsig−Vg=Vsig−(Ve+Vtn) is charged into the capacitor Cs.

(v) Light Emission (GL=L, ES=H, and CS=H)

Figure 33:
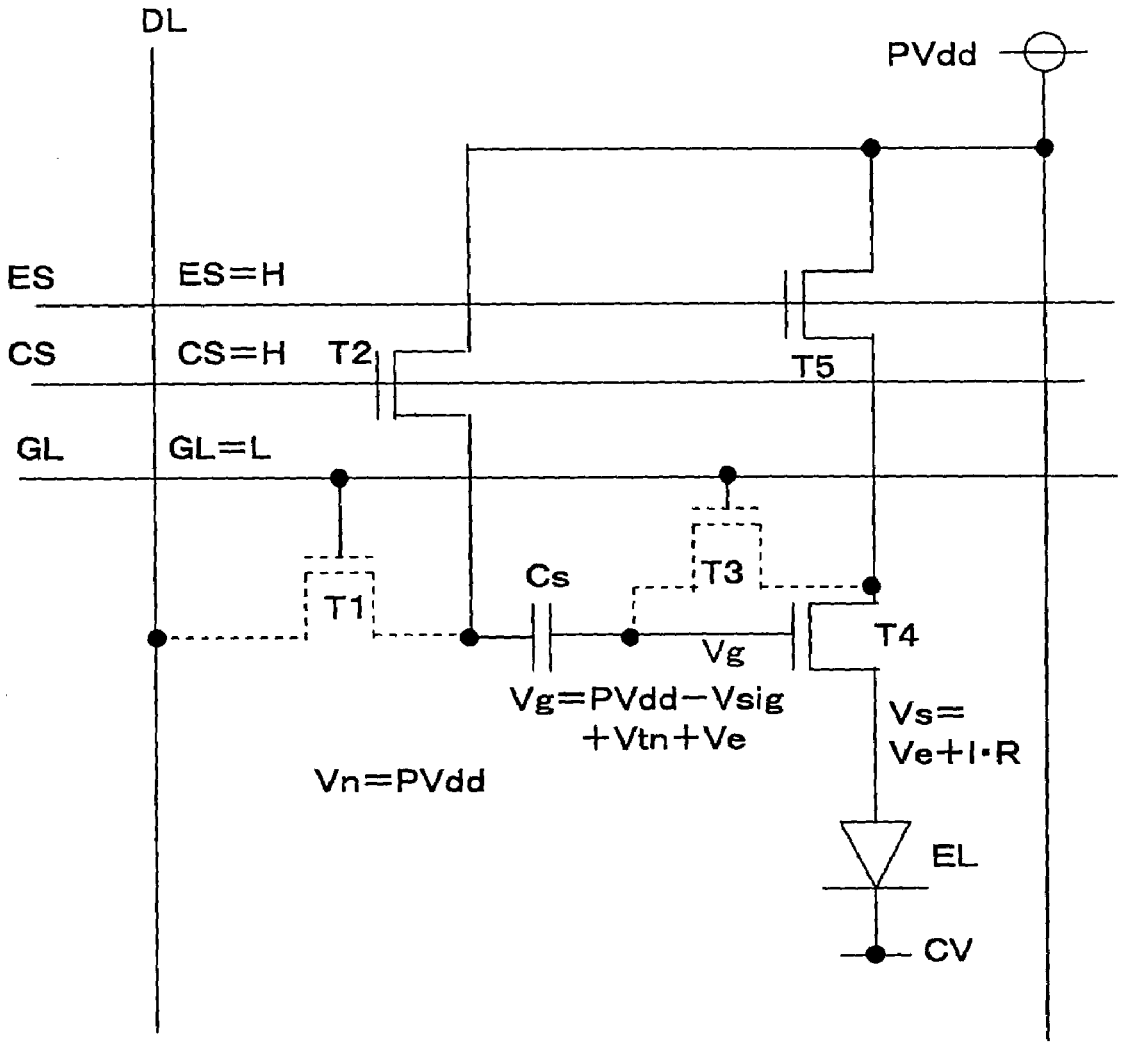
FIG. 33 is a diagram for explaining light emission in the eighth alternative embodiment.

After the potential is fixed, the emission set line ES and the capacitance set line CS are set to the H level. With this process, as shown in FIG. 33, the voltage on the terminal of the capacitor Cs on the side of the selection transistor T1 becomes PVdd, and therefore, the gate voltage Vg of the driver transistor T4 becomes PVdd−Vsig+Ve+Vtn. Because the drive controlling transistor T5 is also switched on, the driver transistor T4 allows a current corresponding to the gate-source voltage Vgs to flow, which is supplied to the organic EL element EL. Here, the source potential Vs of the driver transistor T4 is Ve+I·R, wherein I represents a current value flowing through the organic EL element EL and R represents an on-resistance of the organic EL element EL. Therefore, the gate-source voltage Vgs of the driver transistor T4 is equal to Vg−Vs=PVdd−Vsig+Vtn−I·R.

The on-resistance R of the organic EL element EL can be significantly reduced by increasing an area of the organic EL element and reducing the thickness of the organic layer of the organic EL element. Because the drain current I in the driver transistor T4 is determined by $I=(1/2)\beta(Vgs-Vtn)^2$, it is possible to allow current corresponding to the data voltage Vsig to flow through the driver transistor T4 independent from the threshold voltage of the driver transistor T4. In this representation, β represents an amplification of the driver transistor T4 which is equal to $\mu\epsilon Gw/Gl$ wherein μ is a mobility of the carrier, β is a dielectric constant, Gw is a gate width, and Gl is a gate length.

In particular, the gate-source voltage Vgs of the driver transistor T4 is determined based on a voltage which is reduced from PVdd by the data voltage Vsig. Therefore, as the data voltage Vsig, it is possible to use the same voltage as the data voltage Vsig to be directly supplied to the gate of the p-channel driver transistor and to employ a similar configuration for the circuit for driving the data line DL.

Figure 34:
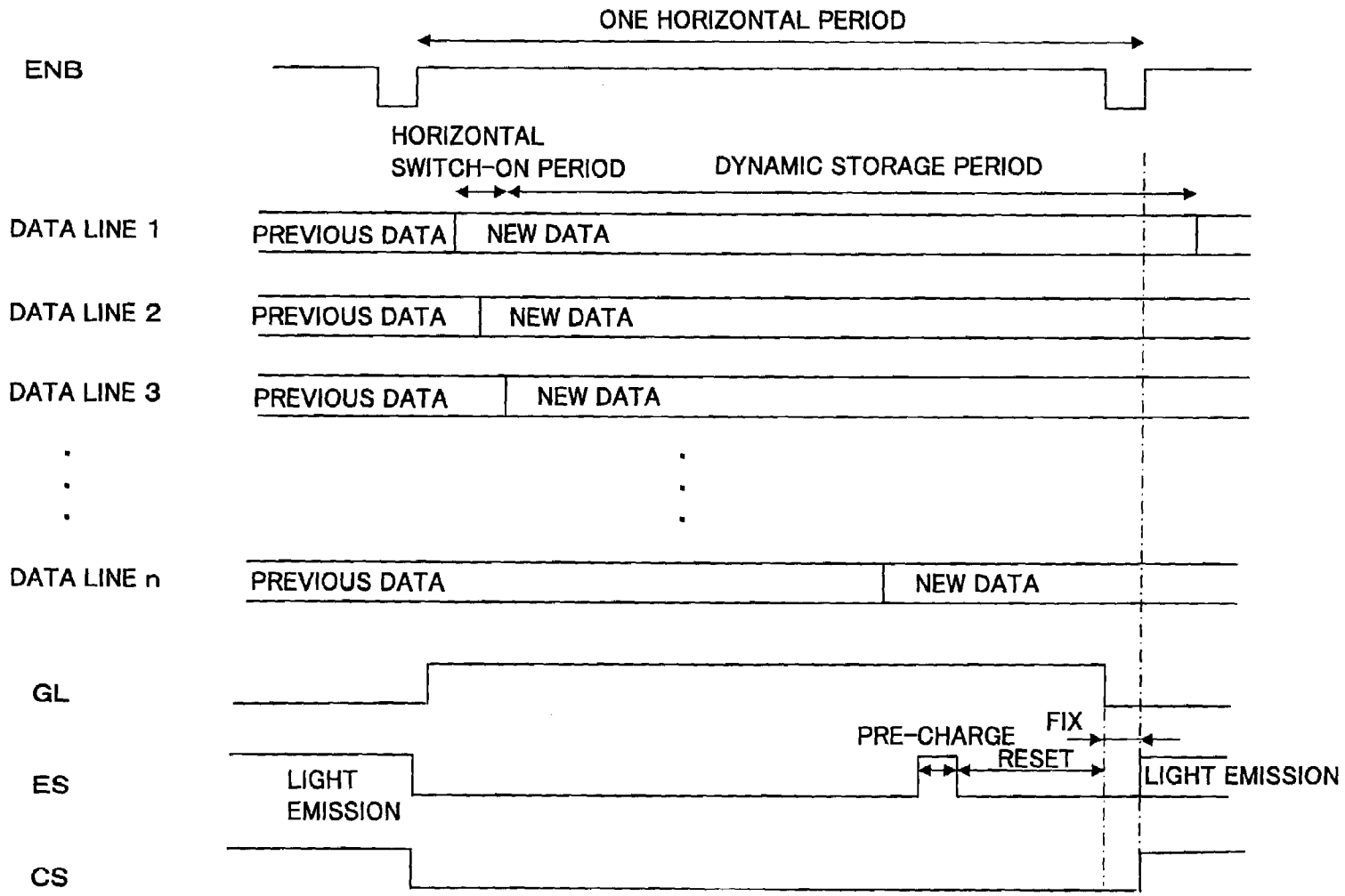
FIG. 34 is a diagram exemplifying a timing of data setting in the eighth alternative embodiment.

Next, a write procedure of the data with respect to pixels in one horizontal line will now be described referring to FIG. 34.

After an L level of an enable signal ENB indicating a start of one horizontal period, data voltages Vsig are written to all data lines DL in a point sequential manner. In other words, a capacitor or the like is connected to the data line DL, and by setting a voltage signal, the data voltage Vsig is stored on the data line DL. The data voltages Vsig for pixels of each column are set on all data lines DL by sequentially setting the data voltages Vsig on the corresponding data line DL.

When the data setting is completed, the emission set line ES is set to the H level for pre-charge and the emission set line ES is then changed back to the L level for reset. By setting the gate line GL back to the L level, the charged voltage of the capacitor Cs within the pixel circuit is fixed, and when the capacitance set line CS is set to the H level, the gate voltage of the driver transistor T4 is shifted and light emission is achieved in all pixels on the horizontal line.

In this manner, it is possible to sequentially write normal video signals (data voltages Vsig) onto the data line DL, set the video signals in the pixel circuits, and achieve light emission.

In particular, it is preferable to employ a configuration in which all transistors (thin film transistor; "TFT") used in the pixel circuit are n-channel transistors as shown in FIG. 30. In general, n-channel transistors have superior characteristics than those of p-channel transistors. Therefore, even when amorphous silicon is employed as the active layer of the transistor, sufficient operation can be achieved. It is therefore possible to eliminate a process for polycrystallization of the active layer to improve the yield.

Even when a capacitor Cs is inserted between the selection transistor T1 and the driver transistor T4, it is possible to use a data signal having the same polarity as that in the related art in which the selection transistor is directly connected to the control terminal of the p-channel driver transistor.

(I) Ninth Alternative Embodiment

Figure 35:
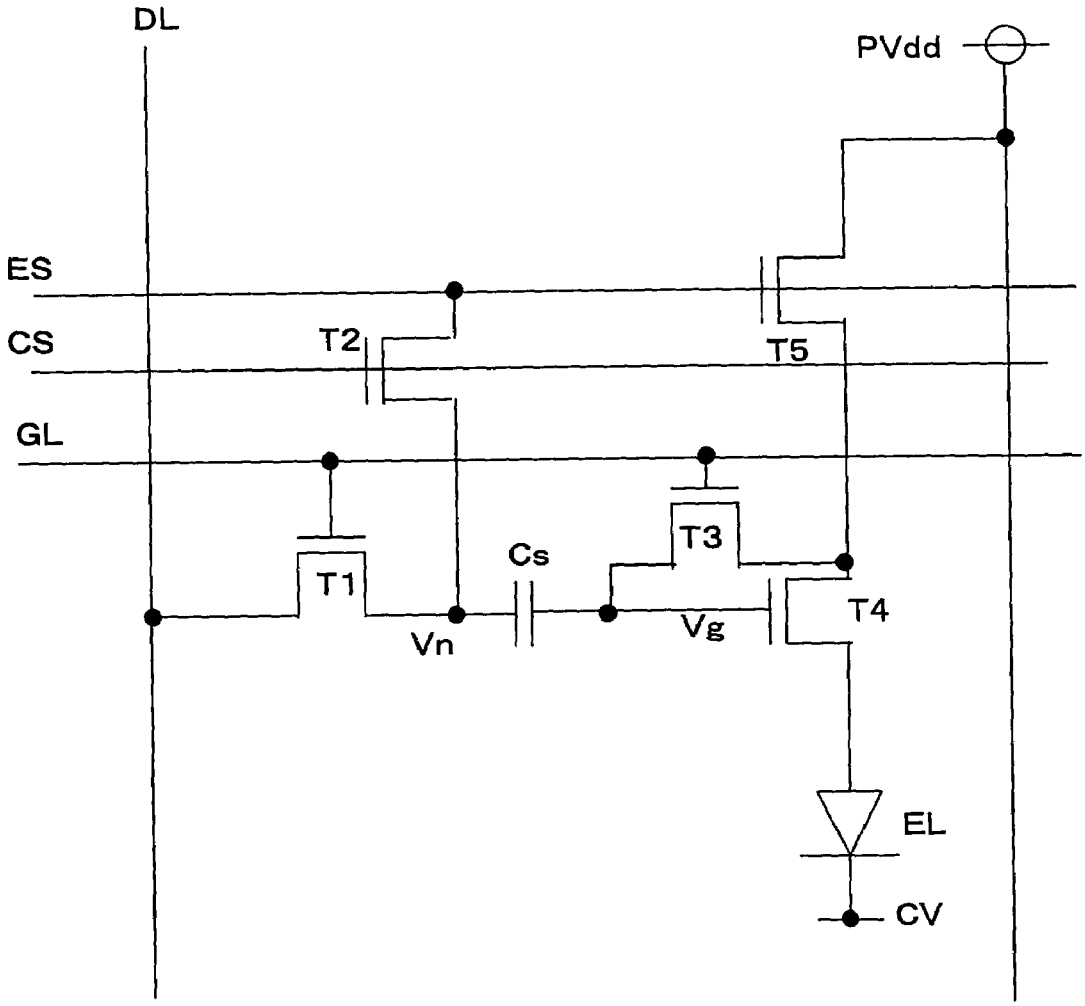
FIG. 35 is a diagram showing a structure of a pixel circuit according to a ninth alternative embodiment.

FIG. 35 shows a structure according to a ninth alternative embodiment of the present invention. In this alternative embodiment, one terminal (drain) of the potential controlling transistor T2 is connected to the emission set line ES and not to the power supply line PVdd. With this structure also, similar advantages to those in the configuration of FIG. 1 can be obtained. In addition, although the emission set line ES is connected to PVdd as the power supply which is identical to the voltage on the power supply line PVdd, the emission set line ES is a line separate from the power supply line PVdd, and as a result there is no voltage change compared to the power supply line PVdd which supplies current to the organic EL element and a more stable operation can be achieved. In other words, when the voltage Vn is set by the potential controlling transistor T2, the setting operation is not affected by the voltage drop on the power supply line PVdd.

What is claimed is:

1. A pixel circuit used in an organic electroluminescence panel, the pixel circuit comprising:

a driver transistor which supplies a drive current corresponding to a potential on a control terminal to an organic electroluminescence element;

a drive controlling transistor which is inserted between a predetermined power supply and the organic electroluminescence element and which switches the drive current on and off;

a short-circuiting transistor which controls whether or not the driver transistor is to be diode-connected;

a selection transistor which controls whether or not a data signal from a data line is to be supplied to the control terminal of the driver transistor;

a capacitor which is inserted between the selection transistor and the control terminal of the driver transistor; and a potential controlling transistor which switches on and off a connection between a terminal of the capacitor on a side of the selection transistor and the predetermined power supply.

2. A pixel circuit according to claim 1, wherein the driver transistor has a first terminal connected to a positive power supply and a second terminal connected to the drive controlling transistor.

3. A pixel circuit according to claim 2, wherein the potential controlling transistor switches on and off a connection between the terminal of the capacitor on the side of the selection transistor and the positive power supply.

4. A pixel circuit according to claim 2, wherein the driver transistor is a p-channel transistor.

5. A pixel circuit according to claim 1, wherein the driver transistor has a first terminal connected to the drive controlling transistor and a second terminal connected to the organic electroluminescence element.

6. A pixel circuit according to claim 5, wherein the potential controlling transistor switches on and off a connection between the terminal of the capacitor on the side of the selection transistor and the positive power supply.

7. A pixel circuit according to claim 5, wherein the driver transistor is an n-channel transistor.

8. A pixel circuit according to claim 1, further comprising:

a control line which is connected to a control terminal of the selection transistor and which controls on and off states of the selection transistor, wherein a control terminal of the short-circuiting transistor is also connected to the control line; and the selection transistor and the short-circuiting transistor are simultaneously switched on and off.

9. A pixel circuit according to claim 1, further comprising:

a control line which is connected to a control terminal of the selection transistor and which controls on and off states of the selection transistor, wherein a control terminal of the potential controlling transistor is also connected to the control line, and when one of the selection transistor and the potential controlling transistor is switched on, another one of the selection transistor and the potential controlling transistor is switched off.

10. A pixel circuit according to claim 1, further comprising:

a control line which is connected to a control terminal of the selection transistor and which controls on and off states of the selection transistor, wherein a control terminal of the short-circuiting transistor and a control terminal of the potential controlling transistor are also connected to the control line, the selection transistor and the short-circuiting transistor are simultaneously switched on and off, and when one of the selection transistor and the potential controlling transistor is switched on, another one of the selection transistor and the potential controlling transistor is switched off.

11. A driving method of a pixel circuit of an organic electroluminescence panel, wherein the pixel circuit comprises:

a driver transistor which supplies a drive current corresponding to a potential on a control terminal to an organic electroluminescence element;

a drive controlling transistor which is inserted between a predetermined power supply and the organic electroluminescence element and which switches the drive current on and off;

a short-circuiting transistor which controls whether or not the driver transistor is to be diode-connected;

a selection transistor which controls whether or not a data signal from a data line is to be supplied to the control terminal of the driver transistor;

a capacitor which is inserted between the selection transistor and the control terminal of the driver transistor; and a potential controlling transistor which switches on and off a connection between a terminal of the capacitor on a side of the selection transistor and the predetermined power supply, and the driving method comprises:

a reset step in which the selection transistor and the short-circuiting transistor are switched on and the potential controlling transistor is switched off, and while a voltage on the terminal of the capacitor on the side of the selection transistor is set to a voltage of a data signal, a voltage on the control terminal of the driver transistor is set to a voltage which is different by a threshold voltage of the driver transistor from a terminal of the driver transistor; and a light emission step in which the selection transistor and the short-circuiting transistor are switched off and the potential controlling transistor is switched on so that a voltage on the control terminal of the driver transistor is set to a voltage corresponding to the voltage of the data signal and the threshold voltage of the driver transistor and the drive controlling transistor is switched on to allow drive current from the driver transistor to flow to the organic electroluminescence element.

12. A driving method of an organic electroluminescence pixel circuit according to claim 11, further comprising as a pre-step of the reset step, a discharge step in which the selection transistor and the short-circuiting transistor are switched on, the potential controlling transistor is switched off, and the drive controlling transistor is switched on to discharge charges on the control terminal of the driver transistor.

13. A pixel circuit according to claim 1, wherein on and off states of the drive controlling transistor are controlled by the emission set line, and the potential controlling transistor switches on and off a connection between the terminal of the capacitor on the side of the selection transistor and the emission set line.

14. A pixel circuit according to claim 13, further comprising:

a control line which is connected to a control terminal of the selection transistor and which controls on and off states of the selection transistor, wherein a control terminal of the potential controlling transistor is also connected to the control line, and the selection transistor and the potential controlling transistor are switched on and off in a complementary manner.

15. A pixel circuit according to claim 14, wherein a control terminal of the short-circuiting transistor is also connected to the control line, and the selection transistor and the short-circuiting transistor are simultaneously switched on and off.

16. A pixel circuit according to claim 13, further comprising:

a control line which is connected to a control terminal of the selection transistor and which controls on and off states of the selection transistor, wherein the emission set line is set to a voltage which switches the drive controlling transistor off after the selection transistor is switched on by the control line and is set to a voltage which switches the drive controlling transistor on after the selection transistor is switched off by the control line.

* * * * *